US006098972A

United States Patent [19]

Klimach et al.

[11] Patent Number: 6,098,972

[45] Date of Patent: Aug. 8, 2000

[54] EDGE CLAMP

[75] Inventors: Horst Klimach, Ilsfeld; Hans Roesch, Gemmrigheim, both of Germany

[73] Assignee: Bessey & Sohn GmbH & Co., Bietigheim-Bissingen, Germany

[21] Appl. No.: 09/211,737

[22] Filed: Dec. 15, 1998

[30] Foreign Application Priority Data

Apr. 17, 1997 [DE] Germany ..... 197 16 005
Dec. 8, 1997 [DE] Germany ..... 197 54 452

[51] Int. Cl.[7] ..... B25B 1/00

[52] U.S. Cl. ..... 269/156; 269/139; 269/218; 81/128; 81/90.2

[58] Field of Search ..... 81/128, 90.2; 269/218, 269/139, 156, 217, 233, 249, 251

[56] References Cited

U.S. PATENT DOCUMENTS 5,350,163 9/1994 Lichtenberg ..... 269/156

FOREIGN PATENT DOCUMENTS 0 267 982 5/1988 European Pat. Off. .
39 25 114 2/1991 Germany .
297 16 828 2/1998 Germany .
196 52 057 6/1998 Germany .
2 164 877 4/1986 United Kingdom .
WO 91/12114 8/1991 WIPO .

*Primary Examiner*—David A. Scherbel
*Assistant Examiner*—Willie Berry, Jr.
*Attorney, Agent, or Firm*—Barry R. Lipsitz

[57] ABSTRACT

In order to provide an edge clamp, in particular, for pressing edge parts onto edges of workpieces extending between an upper side and an underside, comprising a clamp body, a first clamping jaw adapted to abut on the upper side of the workpiece and a second clamping jaw adapted to abut on the underside of the workpiece for fixing the clamp body on the workpiece and a means for generating clamping pressure actuatable by means of an actuating element for acting upon an edge pressure element acting on the edge part, which is as simple as possible to handle and can be fixed securely in position on the workpiece it is suggested that the clamp body have guide means, along which the clamping jaws are guided for displacement towards one another and away from one another and that a securing in position of the clamp body on the workpiece can be achieved by displacing the clamping jaws in the guide means in the direction towards the workpiece.

46 Claims, 13 Drawing Sheets

EDGE CLAMP

The invention relates to an edge clamp, in particular, for pressing edge parts onto edges of workpieces extending between an upper side and an underside, comprising a clamp body, a first clamping jaw adapted to abut on the upper side of the workpiece and a second clamping jaw adapted to abut on the underside of the workpiece for fixing the clamp body on the workpiece and a means for generating clamping pressure actuatable by means of an actuating element for acting upon an edge pressure element acting on the edge part.

All those clamping tools are designated as "edge clamp" which serve, for example, to press profiled edges or so-called edge veneers onto edges of boards. In this respect, the boards are generally held by such edge clamps from the upper side and the underside and an additional spindle is provided which serves to press the profiled edge or the edge veneer against the edge with pressure.

Tools are also known which are attached to a bar of a conventional screw clamp with a wing nut or a similar element and either have one spindle which extends at right angles to the bar and can be guided unsymmetrically and laterally past the bar to the edge of the workpiece or have two spindles extending at right angles to the bar which extend symmetrically past the bar on both sides thereof in the direction of the edge.

Another, known edge clamp comprises a C-shaped clamp body, on which a spindle is arranged on both the upper and lower side arms so as to be adjustable in a nut thread in order to press the clamping jaws against the workpiece and thus fix the clamp body in position on the workpiece. In addition, a third spindle is provided which is arranged in the center part of the clamp body so as to be adjustable and serves to adjust the edge pressure element in the direction of the edge and thus act on the edge part.

The disadvantages of these known tools are their mostly poor hold on the workpiece so that the workpiece moves between the clamping jaws when the edge part is acted upon with the edge pressure element.

DE-U-88 00 461 discloses, in addition, an edge clamp, with which the clamping jaws fixing the workpiece in position can be pivoted spirally and have a non-slip pad. These clamping jaws endeavor to reduce the distance between them on account of their spiral shape as soon as pressure is exerted on the edge part and thus on the workpiece with the edge pressure element. A torsion spring guides these clamping jaws back into their initial abutment.

This tool has the disadvantage that it is necessary to move the clamping jaws, when the edge clamp is applied, to such an extent that they begin to fix the workpiece in position. Only then is it possible to act on the edge part with the edge pressure element.

The object underlying the invention is therefore to create an edge clamp of the generic type which is as simple as possible to handle and can be fixed securely in position on the workpiece.

This object is accomplished in accordance with the invention, in an edge clamp of the type described at the outset, in that the clamp body has guide means, along which the clamping jaws are guided for displacement towards one another and away from one another and that a securing in position of the clamp body on the workpiece can be achieved by displacing the clamping jaws in the guide means in the direction towards the workpiece.

The advantage of the inventive solution is to be seen in the fact that as a result of the displaceability of the clamping jaws along the guide means in their guiding directions the clamping jaws can, on the one hand, be moved easily and, on the other hand, a direction of movement of the clamping jaws can be determined in a simple manner by the guiding direction such that a secure fixing in position of the workpiece is possible with the clamping jaws.

In this respect, the clamping jaws can be advantageously designed such that they abut areally, preferably over a large area, on the workpiece and thus allow a secure clamping without damaging the workpiece.

It is particularly favorable when the clamp body is of an approximately C-shaped design and engages the workpiece on the upper side with its first side arm and on the underside with its second side arm and that the guide means are arranged on the side arms.

With the inventive guide means, different directions of movement of the clamping jaws may be realized. In any case, it is necessary to move the clamping jaws towards one another in a clamping direction. A particularly advantageous embodiment does, however, provide for the clamping jaws to be movable in the guide means in a clamping direction towards the workpiece and at the same time in a transverse direction transversely to the clamping direction. With this movement in the transverse direction transversely to the clamping direction it is possible to achieve additional, advantageous effects during the clamping of the workpiece by means of the clamping jaws.

One advantageous embodiment, for example, provides for the clamping jaws, during a movement in the clamping direction, to be movable in the guide means in addition in the direction of the transverse direction towards the edge pressure element. This solution has, in particular, the advantage that the pressing of the edge part on the workpiece during the clamping of the workpiece between the clamping jaws is additionally assisted.

Another alternative solution provides for the clamping jaws, during a movement in clamping direction, to be movable in the guide means in addition in the direction of the transverse direction away from the edge pressure element. This solution has the advantage that as a result of this movement of the clamping jaws a reinforcement of the clamping of the workpiece between the clamping jaws occurs when, in addition, the edge pressure element acts on the workpiece via the edge part.

All these combined movements in the transverse direction in addition to the movement in clamping direction may be brought about when the guide means extend in guiding directions, the angle of which is smaller than 180°. It is, however, particularly favorable when the two guide means extend in guiding directions which intersect at an angle of less than 90°. This means that an appreciable movement in the transverse direction, which allows the advantages specified above to be particularly effective, is always coupled with the movement in clamping direction.

In conjunction with the preceding explanations concerning the inventive edge clamp no details have been given as to how the clamping jaws are intended to be movable along the guide means. It would, for example, be conceivable to design the clamping jaws to be freely movable along the guide means or to act on the clamping jaws in the direction of their guide means with an elastic biasing means, for example, such that the clamping jaws have the tendency to always transfer into their position moved towards one another to the greatest extent.

A particularly advantageous embodiment does, however, provide for a displacement element to be provided which is movable relative to the clamp body with a means for actuating the clamping jaws and with which the clamping jaws are movable along the guide means. Such a displacement element has the great advantage that, on the one hand, a defined and coupled movement of the clamping jaws can be generated and that, on the other hand, it is also possible to move the clamping jaws along their guide means acted upon by force in a regulatable manner.

The displacement element may be realized in the most varied of ways. A particularly favorable solution provides for the displacement element to have a transverse arm movable relative to the clamp body by the means for actuating the clamping jaws and extending transversely to this, this transverse arm acting on the clamping jaws via side arms. As a result of movement of the transverse arm, a correlated movement of the clamping jaws on the two side arms of the clamp body can be generated in the guide means.

The displacement element can be designed in the most varied of ways. It is, for example, conceivable to design the displacement element such that the side arms are rigidly connected to the transverse arm.

An alternative solution provides for the side arms to be articulatedly connected to the transverse arm.

In conjunction with the embodiments described thus far no details have been given as to whether the clamping jaws are merely guided in the respective guiding directions or aligned in addition in a defined manner. In order, in particular, to facilitate abutment of the clamping jaws on the workpiece, it is particularly favorable when the clamping jaws are guided by an aligning element.

In this respect it is conceivable either to design the displacement element as aligning element which thus defines the alignment of the clamping jaws relative to one another.

Alternatively thereto, it is provided for the guide means to be designed as aligning elements and to guide the clamping jaws for movement in the guiding directions aligned in a defined manner relative to one another.

In order to maintain the flexibility during clamping of workpieces of different thicknesses, it is particularly favorable when the clamping jaws can be fixed in position in the aligning elements so as to be aligned in several positions.

With respect to the clamping jaws themselves, no further details have so far been given. One advantageous embodiment, for example, provides for the clamping jaws to have clamping jaw members guided in the guide means. In this respect, it is conceivable for the clamping jaw members themselves to bear clamping surfaces and thus abut directly on the workpiece.

Another advantageous solution provides for clamping surface supports, which support the clamping surfaces, to be held on the clamping jaw members.

These clamping surface supports could be securely connected to the clamping jaw members.

It is, however, also conceivable to design the clamping surface supports such that they are mounted on the clamping jaw members by means of guide bars similar to parallelograms. It is thus possible to move the clamping surface supports relative to the clamping jaw members and, in addition, to specify a defined alignment of the clamping surfaces.

A particularly expedient solution provides for the clamping surface supports to be movable relative to the clamping jaw members from a position abutting on them into a clamping reinforcing position lifted away from the clamping jaw members. This means that the clamping surface supports have the possibility of moving away from the clamping jaw members, wherein the clamping surface supports are moved further towards one another so that as a result of the clamping surface supports being lifted away from the clamping jaw members a clamping reinforcing effect thereof on the workpiece results.

The guide bars similar to parallelograms could, in principle, act as parallelograms so that the alignment of the clamping surface in the position of the clamping surface supports abutting on the clamping jaw members is approximately the same as the alignment in the position of the clamping surface supports lifted away from the clamping jaw members. A particularly expedient solution does, however, provide for the clamping surface of the clamping surface support to be inclined through an angle in the position lifted away from the clamping jaw member in comparison with the position abutting on the clamping jaw member. With such a solution it is possible to generate additional effects by changing the inclination of the clamping surface.

A particularly favorable solution provides for the inclination of the clamping surface in the position lifted away from the clamping jaw member to be selected to compensate at least partially for any widening of the side arms. This means that when the clamping jaw supports lift away from the clamping jaw members and thus increase the clamping of the workpiece the widening of the side arms of the clamp body associated with this can be compensated by the fact that the inclination of the clamping surfaces is likewise changed and thus, in the end, the clamping surfaces essentially retain the original orientation relative to the workpiece when the side arms widen, i.e. in the simplest case are still oriented parallel to one another.

A particularly favorable solution provides for the clamping surface supports to be movable away from the edge pressure element during the movement from the position abutting on the clamping jaw member into the position lifted away from the clamping jaw member. It is thus possible to use the pressure effect of the edge pressure element such that the clamping surface supports already clamping the workpiece move on account of the pressure effect of the edge pressure element in the pressure direction thereof and thereby act in a clamping reinforcing manner on the clamping surfaces and thus the workpiece.

With respect to the design of the clamping surfaces themselves the most varied of solutions are conceivable. One advantageous embodiment, for example, provides for the clamping surfaces to be metallic surfaces. However, in order to bring about a clamping of the workpiece relatively quickly and, in particular, to bring about a rapid gripping of the workpiece on account of the additional movement of the clamping jaws in the transverse direction, it is preferably provided for the clamping surfaces to bear elastic pads. It is possible due to these elastic pads to compress the pads and thus likewise bring about a reinforced clamping of the workpiece.

Furthermore, a particularly advantageous embodiment provides for the pads to be produced from a material engaging in a non-slip manner on the workpiece since, in this case, a quick and reliable first clamping of the workpiece is possible and then, due to further force action, a final, secure clamping of the workpiece is attained.

A particularly advantageous embodiment provides for the pads to comprise an elastomeric material.

Alternatively or supplementary thereto, one advantageous embodiment provides for the pads to comprise a soft material.

With respect to the design of the edge pressure element no further details have been given in conjunction with the preceding explanations of the individual embodiments of the inventive solution. One advantageous embodiment, for example, provides for the clamp body to bear the edge pressure element, i.e. for the edge pressure element to be supported on the clamp body.

In this case, it is expediently provided for the movement of the clamping jaws in the transverse direction to take place in the direction towards the edge pressure element, i.e. for the clamping jaws to move, in addition, in the direction towards the edge pressure element during clamping of the workpiece and thus for pressure to act on the edge part along with the secure clamping of the workpiece between the clamping jaws, in particular, when the edge part already abuts on the edge pressure element prior to abutment of the clamping jaws on the workpiece since the clamping jaws move in the direction of the edge pressure element during the final secure clamping of the workpiece and thus press the workpiece with the edge part against the edge pressure element.

In this respect it is particularly favorable when the clamping surfaces are provided with elastic pads since, in this particular case, the elasticity of the pads makes an additional distance of the clamping jaws in the direction towards the edge pressure element possible which creates the possibility in a particularly advantageous manner of exerting the required pressure on the edge part in order to press this against the workpiece.

Alternatively thereto, another advantageous solution provides for the edge pressure element to be a part movable in relation to the clamp body, in particular, by the means for generating clamping pressure so that an additional movability of the edge pressure element relative to the clamp body exists which makes it particularly easy to act on the edge part with sufficient pressure on the part of the edge pressure element during the clamping of the workpiece by means of the clamping jaws or after clamping of the workpiece by means of the clamping jaws.

In the embodiments of the inventive solution explained thus far, no details have been given as to how actuation of the means for generating clamping pressure is brought about and how clamping of the workpiece between the clamping jaws is intended to be initiated. It is conceivable within the scope of the inventive solution, for example, to provide one actuating element for the clamping of the workpiece between the clamping jaws and one actuating element for actuating the means for generating clamping pressure.

A particularly advantageous solution does, however, provide for both clamping of the workpiece between the clamping jaws and actuation of the means for generating clamping pressure to be brought about with one actuating element so that the inventive edge clamp is therefore particularly simple to handle and use.

Nevertheless, the actuating element could be designed such that this carries out different functions due to different actuation and so two hands are, for example, required to actuate the actuating element on the edge clamp. A particularly advantageous solution does, however, provide for the actuating element to be designed as a one-hand actuation.

A particularly advantageous solution provides for the means for actuating the clamping jaws as well as the means for generating clamping pressure to be actuatable with the actuating element.

In order to be able to realize the actuation of these two means in a simple manner, a particularly expedient embodiment provides for the actuating element to be couplable to the means for actuating the clamping jaws with a releasable coupling. This means that the actuation of the means for actuating the clamping jaws can be realized via the coupling by coupling to the actuating element or can also be interrupted, namely due to release of the coupling.

This coupling can be actuatable manually, for example, i.e. due to actuation of a corresponding handle. A particularly advantageous embodiment does, however, provide for the coupling to be designed as a self-releasing coupling when a workpiece is clamped between the clamping jaws, i.e. no separate actuation of the coupling is necessary but the coupling releases itself when the workpiece is clamped between the clamping jaws and thus the actuation of the means for actuating the clamping jaws is interrupted.

The coupling can be designed in the most varied of ways. For example, the coupling can be actuated via a mechanical activating or deactivating means which recognizes whether the workpiece is clamped between the clamping jaws or not. A particularly simple solution provides for the coupling to be designed as a slip coupling, i.e. when the means for actuating the clamping jaws offers large resistance to the actuating element since, namely, the workpiece is fixed in position between the clamping jaws, a decoupling of actuating element and means for actuating the clamping jaws can be realized due to triggering of the slip coupling.

With respect to the actuation of the means for generating clamping pressure, no further details have been given in this connection. It is, for example, particularly advantageous when the means for generating clamping pressure is coupled directly to the actuating element, i.e. that, in this case, a coupling between the actuating element and the means for generating clamping pressure always exists but the actuation of the means for actuating the clamping jaws can take place via the coupling or can be interrupted due to release of the coupling.

With respect to the design of the means for generating clamping pressure, no further details have been given in conjunction with the explanations concerning the preceding embodiments. One advantageous solution which is particularly preferred on account of its simplicity provides for the means for generating clamping pressure to comprise a cocking spindle.

Furthermore, no additional explanations concerning the design of the means for actuating the clamping jaws have been given in conjunction with the preceding explanations concerning the individual embodiments. One solution which can be realized in a particularly simple manner from a constructional point of view provides for the means for actuating the clamping jaws to comprise an adjusting spindle, with which the displacement element is movable relative to the clamp body. Such an adjusting spindle is preferably designed such that it interacts with an axial bearing as first point of force application and with a spindle nut as second point of force application, wherein these two points of force application serve to move the displacement element relative to the clamp body.

The points of force application can, for example, be rigidly arranged not only on the displacement element but also on the clamp body.

One expedient solution provides for one of the points of force application to act on the displacement element via an elastic element, i.e. the elastic element creates the possibility of being able to turn the spindle further when the movement of the displacement element is blocked due to the fact that the clamping jaws are already securely clamping the workpiece and of thus storing an elastic force in the elastic element which always acts on the displacement element with a force, even if, for example, a yieldingness in the clamping of the workpiece were to occur due to tolerances.

Another advantageous solution provides for one of the points of force application to act on the clamp body via an elastic element. In this case, as well, it is possible to maintain a force always acting on the clamp body and the displacement element via the elastic biasing means, this force seeing to it that the workpiece always remains securely clamped between the clamping jaws.

A particularly simple solution from a constructional point of view provides for the adjusting spindle to form at the same time the cocking spindle. In this case, an elastic element between the clamp body and the corresponding point of force application of the adjusting spindle is of particular advantage since, in this case, the adjusting spindle can be used to act further as cocking spindle at the same time, namely with deformation of the elastic element and thus to generate an additional force acting on the clamping pressure element.

This may be realized particularly easily when the adjusting spindle acts directly on the edge pressure element.

In all the embodiments, in which the inventive edge clamp has, on the one hand, an adjusting spindle for fixing the workpiece between the clamping jaws and, on the other hand, a cocking spindle for acting with pressure on the edge pressure element which need not necessarily be actuatable by a single actuating element, it is advantageously provided for the adjusting spindle and the cocking spindle to be arranged coaxially to one another since a particularly favorable, constructional realization of the means for actuating the clamping jaws and the means for generating clamping pressure can thus be realized. For example, two actuating elements coaxial to one another can be provided in such a case, namely one for the adjusting spindle and one for the cocking spindle.

A particularly favorable solution provides, in addition, for the cocking spindle to be designed as inner spindle in relation to the adjusting spindle and be displaceable in the direction of the spindle axis due to rotation relative to the adjusting spindle. In this case, a compact realization of the arrangement of cocking spindle and adjusting spindle is given.

This solution is particularly favorable when the cocking spindle is supported on the clamp body via the adjusting spindle, i.e. that the cocking spindle is supported, for its part, on the adjusting spindle and then this, in the end, supports both spindles on the clamp body.

A particularly simple actuation of the cocking spindle is possible in this case when the actuating element for the cocking spindle is mounted on the adjusting spindle so as to be rotatable.

In the case of such a rotatable mounting of the actuating element on the adjusting spindle, it is preferably provided for the cocking spindle to be displaceable in the direction of the spindle axis relative to the actuating element but be non-rotatably connected to this.

Several embodiments of the inventive solution have, in particular, the advantage that an edge clamp can be realized which is, above all, actuatable with one hand so that the edge part to be attached, for example, the edge veneer can be held with the free hand and that the edge clamp is, moreover, constructed such that any decrease in the clamping force on the edge veneer and thus any slipping away on both sides of the workpiece is not possible.

In addition, several embodiments of the inventive solution create the possibility of not acting on the edge part, for example, the edge veneer with a rotating movement and this with as large a surface area as possible in order to make a better distribution of pressure possible.

In one inventive embodiment, the application of force to a front edge of the edge part takes place with a spindle customary in the case of screw clamps, but not directly onto the edge part or the edge with the pressure plate customary in screw clamps but via a displaceable pressure piece. This pressure piece can also be pivotable in order to have the possibility of also pressing on shaped profiles. The thread of the spindle nut can be arranged in the center part of the C-shaped clamp housing.

In a further, advantageous embodiment, the clamping jaws are automatically guided in the C-shaped clamp body or housing on each side arm in such a manner that they are movable away from and towards one another in accordance with the spindle movement and are movable away from one another to such an extent that they can be lifted beyond an edge veneer protruding over an edge of the workpiece, not only during application of the edge clamp to the workpiece but also during its removal.

A particularly advantageous embodiment of an inventive one-hand edge clamp for pressing on edge parts, in particular, edge veneers and profiled edges on board-like flat workpieces, for example, boards for furniture, table tops, worktops etc. a known C-shaped screw clamp comprises a clamp body, wherein clamping jaws are arranged on the side arms of the C-shaped clamp body and move on inclined planes extending inwardly or in guiding directions, for example realized by way of longitudinal recesses, wherein the distance between the clamping jaws increases when the spindle is turned back and is reduced when the spindle is turned forwards, wherein the spindle has, for example, a spindle nut in the transverse arm of the displacement element and the spindle is further provided with a pressure plate which is rotatably held on a center part of the clamp body.

In this respect, it is particularly favorable when the necessary movements of the clamping jaws can be determined by way of longitudinal recesses which are arranged on the displacement element and the center line of which extends at right angles to the spindle axis, i.e., in clamping direction.

In this respect, the clamp body is preferably provided for the necessary movement of the clamping jaws secured against turning with longitudinal recesses which extend in guiding direction and form the guide means. It is particularly favorable when two longitudinal recesses extending parallel to one another in the guiding direction are provided per guide means.

A particularly favorable solution provides for the clamping jaws to each have two bores, into which an aligning bolt can be inserted in order to be able to turn the clamping jaws into two different clamping positions which then also define two different clamping areas with clamping surfaces respectively arranged at different distances.

A further, particularly advantageous embodiment provides for the edge pressure element to have a clamping surface which is of a resilient design, for example, is provided with an elastic or soft-material pad in order to clamp the edge part as gently as possible.

A further, advantageous embodiment provides advantageously for all the necessary functions of the edge clamp to be performed, for example, with the rotary movement of a spindle via a handle as actuating element, i.e., on the one hand, the application of the edge clamp, fixing the clamping jaws in position on the, for example, board-shaped workpiece, bringing the edge pressure element closer to the edge part of the workpiece and acting on the edge part with pressure while the workpiece is firmly clamped between the clamping jaws.

It is preferably provided, in particular, for the clamping jaws to be actuated with actuation of the spindle and brought closer to the workpiece on both sides. With abutment of the clamping jaws on the workpiece and clamping thereof, initiating the pressure acting on the edge part can be realized as additional function, i.e. the spindle can be displaced against the edge part of the workpiece, after the workpiece has been clamped by means of the clamping jaws, until it rests against the same. With further actuation of the spindle, the pressure force can then be applied to the edge part.

A particularly advantageous embodiment provides for the one-hand edge clamp for pressing edge parts, such as, for example, edge veneers and profiled edges, onto board-like flat workpieces, for example boards for furniture, table tops, worktops etc., to have a large C-shaped clamp body with two clamping jaws for securing the clamp body in position on the workpiece, in particular, on an upper side and an underside thereof and an edge pressure element which serves to clamp the edge part or the so-called edge veneer. In this respect, not only the clamping jaws but also the edge pressure element can be automatically moved with one hand, wherein the clamping jaws and the edge pressure element can be moved towards the corresponding sides of the workpiece upon actuation with one hand.

In this respect, it is particularly favorable when a clamping element mounted on the C-shaped clamp body serves for adjustment of the clamping jaws and the edge pressure element. This clamping element is preferably actuatable with a handle.

The clamping jaws and the edge pressure element are each preferably provided with a flat, areal pressure surface.

A particularly favorable solution provides for the clamping jaws to have clamping jaw members, on which clamping surface supports are mounted via guide bars so as to be movable. The guide bars are preferably aligned such that upon pressure action of the edge pressure element the clamping surface supports are lifted away from the clamping jaw members in a manner reinforcing the clamping force and serve to clamp the workpiece even more firmly.

A particularly favorable solution provides for the inventive one-hand edge clamp to have an outer spindle and in inner spindle which can be actuated with one handle. The displacement element is preferably movable relative to the clamp body due to actuation of the turning handle of the spindle in order to adjust the jaws in the direction of the workpiece or away from this.

Furthermore, a slip coupling is preferably provided between the turning handle and the outer spindle for rotation of the outer spindle, wherein the slip coupling has, in the simplest case, a biased set of springs which makes continued rotation of the turning handle possible when the outer spindle is blocked in order to rotate the inner spindle.

The inner spindle is preferably connected to the turning handle via an entraining member in a non-rotatable manner but is displaceable in axial direction.

The edge pressure element is preferably movable with the inner spindle in the direction towards the workpiece.

The edge pressure element preferably has an areal pressure plate which is non-rotatably guided on the clamp body and, for example, is also securely connected to the inner spindle on an axial bearing.

Additional features of the invention are the subject matter of the following description as well as the drawings illustrating several embodiments.

Figure 1:
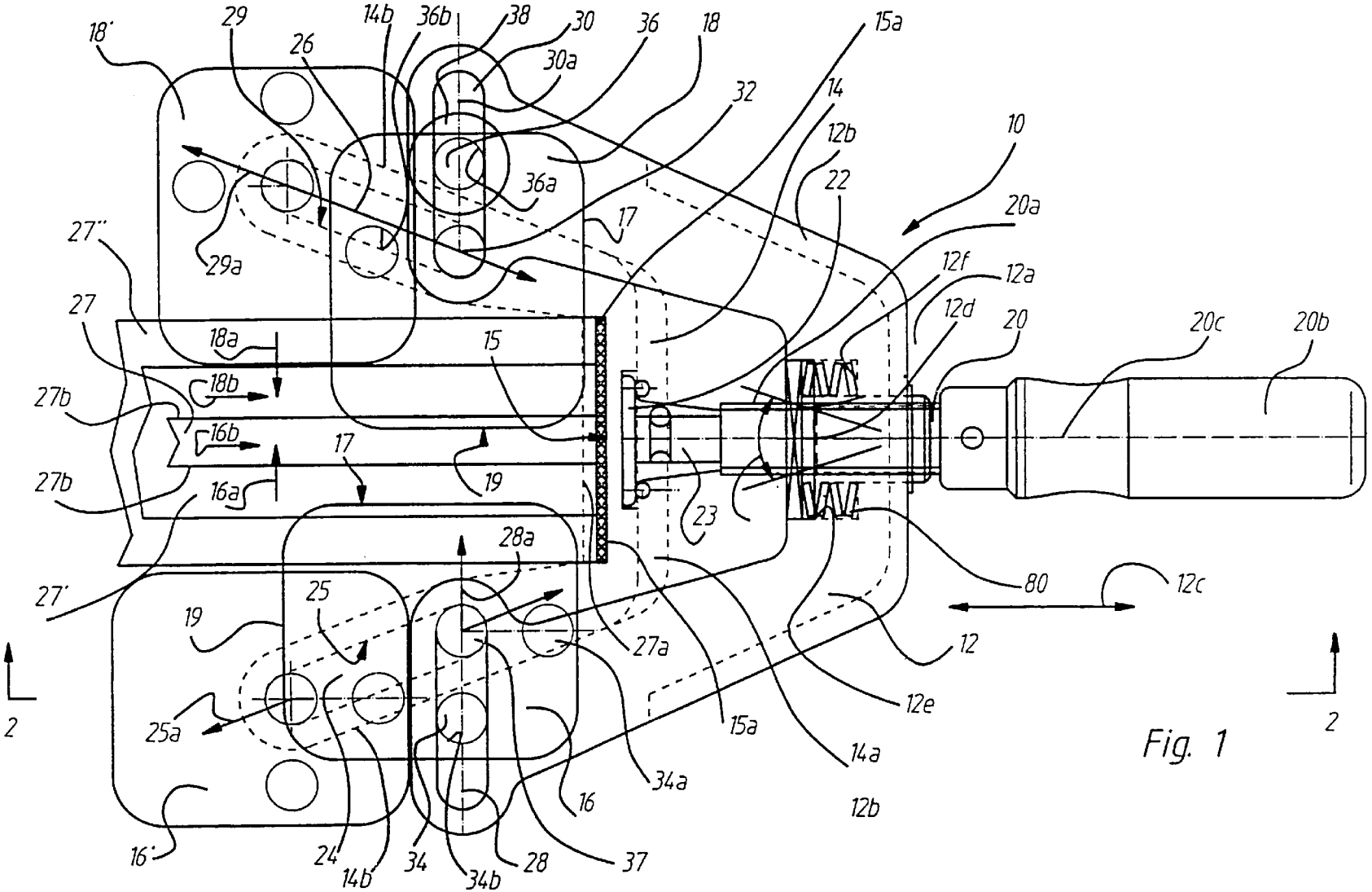
FIG. 1 shows a plan view of a first embodiment of the inventive solution.

A first embodiment of an inventive edge clamp, designated in FIG. 1 as a whole as 10, comprises a clamp body 14 which is designed, for example, in the shape of a bridge and illustrated in FIG. 1 by dashed lines.

This clamp body 14 is provided with a center part 14*a* with side arms 14*b* integrally formed on its two outer ends so that the two side arms 14*b*, together with the center part 14*a*, result altogether in a C-shape of the clamp body 14.

Guide means 25, 29 are provided in the two side arms 14*b* and these are, for example, formed by longitudinal recesses 24, 26 which extend in a guiding direction 25*a*, 29*a* and in which clamping jaws 16, 18 are guided for movement in the respective guiding directions 25*a*, 29*a* by means of guide bolts 32, 37.

Furthermore, the edge clamp 10 has a displacement element 12, with which the clamping jaws 16, 18 are displaceable towards one another in a clamping direction 16*a*, 18*a* from a non-clamping, open position 16', 18' and, at the same time, in a transverse direction 16*b*, 18*b* in relation hereto in the direction of the central part 14*a*, wherein the respective guiding directions 25*a*, 29*a* define the relation between the extent of the movement in the clamping direction 16*a*, 18*a* relative to the extent of the movement in the transverse direction 16*b*, 18*b*.

The guiding directions 25*a*, 29*a* preferably extend at an angle $\alpha$ relative to one another which is smaller than 180°, preferably smaller than 90°.

The displacement element 12 is preferably provided with a transverse arm 12*a*, at the end of which side arms 12*b* are integrally formed, so that the displacement element 12 also has approximately a C shape in the case of the first embodiment.

The side arms 12*b* are provided at their respective ends with longitudinal recesses 28, 30 serving as aligning elements which extend with their longitudinal direction in an aligning direction 28*a*, 30*a*, wherein these aligning directions 28*a*, 30*a* preferably extend parallel to the clamping directions 16*a*, 18*a*.

The guide bolts 37, 32 likewise engage in these longitudinal recesses 28, 30. In addition, aligning bolts 34, 36 also engage in these longitudinal recesses 28, 30 and these are likewise held on the clamping jaws 16, 18, can preferably be inserted through a bore 34*a*, 36*a* in the clamping jaws.

The clamping jaws 16, 18 are preferably provided with two bores, namely a bore 34*a* and 36*a* as well as a bore 34*b* and 36*b* which are arranged around the guide bolts 37, 32 at a respective angular spacing of 90° and allow a positioning of the clamping jaws 16, 18 in two positions turned through 90° in relation to one another, depending on whether the aligning bolt 34, 36 is located in the bore 34*a*, 36*a* or in the bore 34*b*, 36*b*.

In FIG. 1, in order to illustrate both rotary positions, the clamping jaws 16 are shown in the position, in which the aligning bolt 34 is located in the bore 34*b* whereas the clamping jaws 18 are illustrated such that the aligning bolt 36 is located in the bore 36*a*.

Due to the fact that not only the guide bolts 37, 32 but also the aligning bolts 34, 36 are arranged in the respective longitudinal recess 28, 30 and movable in this, the clamping jaws 16, 18 are also clearly aligned in their respective position and thus each of the clamping jaws 16 is movable along the corresponding guiding direction 25*a*, 29*a* as a result of movement of the displacement element 12 in a direction of displacement 12*c*.

In order to move the displacement element 12 relative to the clamp body 14, a spindle is provided which is designated as a whole as 20 and has a threaded section 20*a* which penetrates a spindle nut 12*d* and a turning handle 20*b* for turning the spindle 20. Furthermore, the spindle 20 bears at its front spindle end 23 designed as attachment a pressure part 22 which is rotatable in relation to the spindle end 23 but is mounted so as to be preferably non-displaceable axially and abuts on the center part 14*a* of the clamp body 14 and is fixed in position on this.

The spindle nut 12*d* is, for its part, non-rotatably mounted in the transverse arm 12*a* and supported on the transverse arm 12*a* in a resilient manner via a set of springs designated as a whole as 80. For this purpose, a recess 12*e* in the transverse arm 12*a* which guides the spindle nut 12*d* non-rotatably is preferably provided and the set of springs 80 located between a recess base 12*f* and the spindle nut 12*d* is also arranged in this recess.

The entire spindle 20 extends with its spindle axis 20*c* parallel to the direction of displacement 12*c* and also parallel to the transverse directions 16*b* and 18*b* so that the entire displacement element 12 can be displaced relative to the clamp body 14 by means of the spindle 20.

In order to clamp a workpiece 27 designed, for example, as a board and in order to press an edge part 27*a* onto it, the center part 14*a* of the clamp body 14 is designed at the same time as edge pressure element and provided with an edge pressure surface 15 which extends transversely to the transverse directions 16*b* and 18*b* and thus also transversely to the spindle axis 20*c* or to the direction of displacement 12*c*.

The edge pressure surface 15 is preferably covered with a pad 15*a* consisting of soft elastic material which makes an additional pressure elasticity available.

Furthermore, the clamping jaws 16, 18 are provided with clamping surfaces 17, 19, wherein the clamping surfaces 19 are effective in the position of the clamping jaws, in which the clamping jaw 18 is shown, and the clamping surfaces 17 in the position, in which the clamping jaw 16 is shown.

The clamping surfaces 17, 19 are preferably provided, in addition, with a soft elastic pad which is not, however, illustrated in FIG. 1.

For application to the workpiece 27, which can have the thickness shown for the workpiece 27 or the workpiece 27' or the workpiece 27", the spindle 20 is turned to such an extent that the clamping jaws 16, 18 are in their initial position, in which they have the greatest distance from one another. In this position, the guide bolt 37 preferably abuts on an end of the longitudinal recesses 24, 26 facing away from the center part 14*a*. In this position, the edge clamp may now be pushed with its C-shaped clamp body 14 onto the workpiece such that one of the clamping jaws 16, 18 is associated with an upper side 27*a* with its clamping surface 17 or 19 and the other with an underside 27*c* of the workpiece 27. Furthermore, the edge part 27*a* is arranged on the workpiece 27 such that this faces the edge pressure surface 15. The edge clamp 10 is now moved over the workpiece 27 to such an extent that the edge pressure surface 15, where applicable via the pad 15*a*, acts on the edge part 27*a* and partially acts upon this with pressure. By turning the spindle 20, the displacement element 12 may now be moved in the direction of displacement 12*c* away from the clamp body 14, wherein the longitudinal recesses 28, 30 act on the guide bolts 37, 32 as well as the aligning bolts 34, 36 and displace the clamping jaws 16, 18 in the direction of the center part 14*a*, namely along the respective guiding direction 25*a*, 29*a*, and thereby move the two clamping jaws 16, 18 towards one another in clamping direction 16*a*, 18*a* and at the same time move them in the transverse direction 16*b*, 18*b* in the direction of the center part 14*a*.

If the clamping jaws 16, 18 now come to rest with their clamping surfaces 17 or 19 on the upper side 27*b* and the underside 27*c* of the workpiece 27, a clamping of the workpiece 27 between them thereby results and thus a fixing of the clamp body 14 in position relative to the workpiece 27*a*.

If the spindle 20 is now turned further, the movement of the clamping jaws 16, 18 in the transverse directions 16*b*, 18*b* results in the workpiece clamped between them being moved in the direction of the edge pressure surface 15 and thus the edge pressure surface 15 acting with increased pressure on the edge part 27*a*, where applicable via the pad 15*a*, and thus the edge part 27*a* abutting with pressure on the workpiece 27.

In order to ensure a secure clamping of the workpiece 27, the spindle 20 can now be turned further, wherein the spindle nut 12*d* acts on the set of springs 80 and thus the set of springs 80 generates on account of the tension thereby generated an elastic force component which always keeps the displacement element 12 acted upon away from the clamp body 14.

Figure 2:
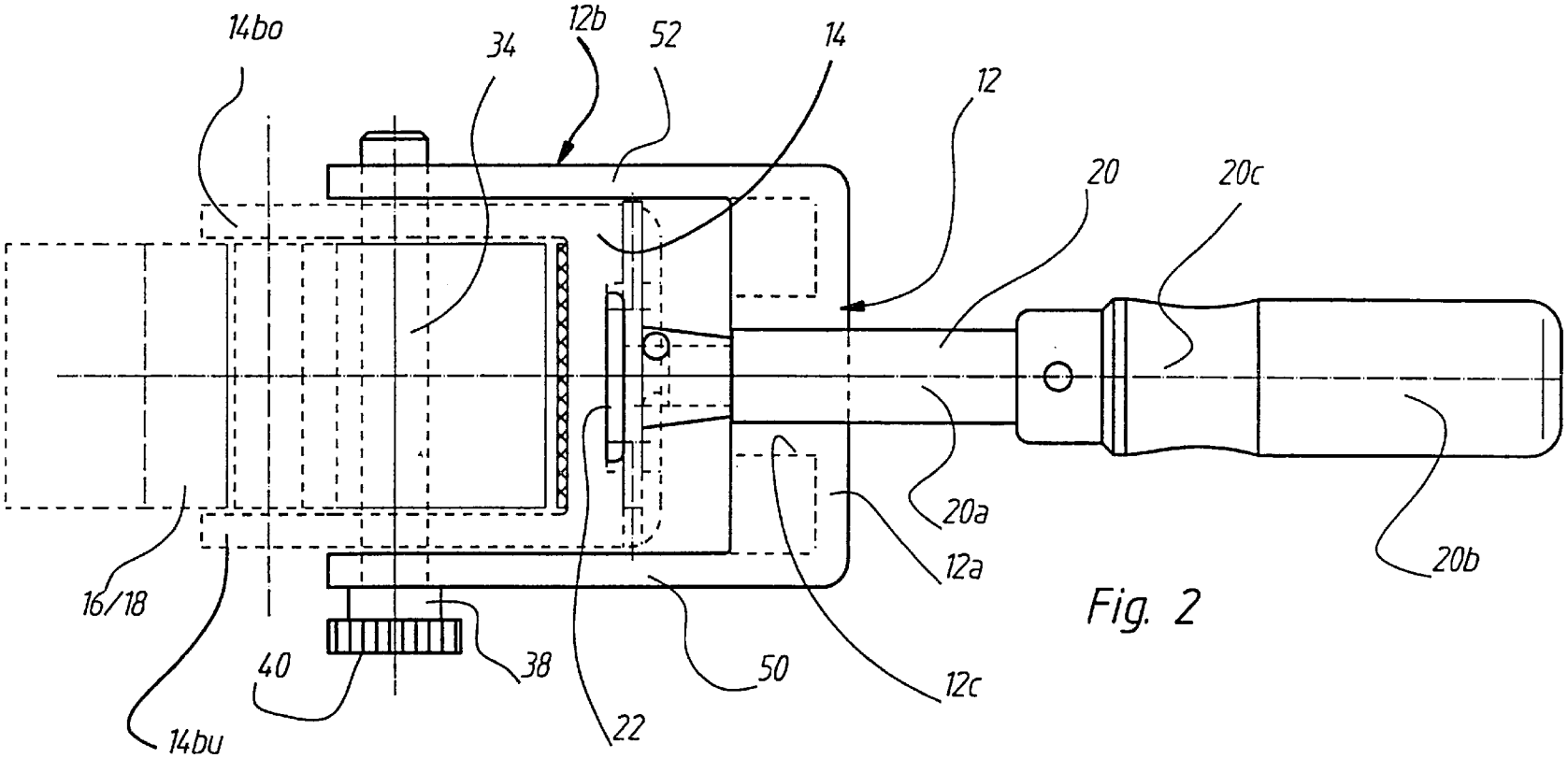
FIG. 2 shows a section along line 2—2 in FIG. 1.

It is provided, in particular, in the embodiment illustrated in FIGS. 1 and 2 that via the clamp body 14 or the bridge 14 and the pressure part 22 or pressure plate 22 fixed securely therein but rotatable on the spindle the clamping jaws 16 and 18 are automatically guided in the longitudinal recesses 24 and 26 extending from the outside to the inside or vice versa via the bolts 37, 32. The pressure part 22 or the pressure plate are, for example, rotatable cylindrically on the spindle end 23 or the attachment of the spindle 20 but are not pivotally mounted. The clamping jaws 16, 18 may move in the longitudinal recesses 24 and 26 of the clamp body 14 and in the recesses 28, 30 in the displacement element 12, wherein the displacement element 12 can be designed, for example, as a housing. The longitudinal recesses 24, 26 extending with their guiding directions 25*a*, 29*a* in the shape of an arrow in relation to one another represent the guide means 25, 29 for clamping the grasped workpiece 27 or 27' or 27" and the longitudinal recesses 28 and 30 in the displacement element 12 serve to balance the stroke of the movement of the clamping jaws 16, 18 in the clamping direction 16*a* inwards towards one another. When the spindle 20 is turned, the clamp body is displaced relative to the displacement element 12, namely during a rotary movement of the spindle 20 such that the clamp body 14 and the displacement element 12 move away from one another while in the other direction of rotation the clamp body 14 and the displacement element 12 are moved towards one another and the clamping jaws 16 and 18 are thereby automatically closed or opened.

In order to avoid any tilting during clamping, each of the clamping jaws 16, 18 is penetrated not only by the respective guide bolt 37, 32 but additional bores 34*a* and 36*a* as well as 34*b* and 36*b* are provided in the respective clamping jaws 16, 18, into which an aligning bolt 34, 36 can be inserted which is provided with a head 38. Thus, the clamping jaws 16, 18 are movable for different thicknesses of the workpiece 27, in particular, different board thicknesses over different clamping areas in clamping direction 16*a*, 18*a*, wherein a clamping stroke in the clamping direction 16*a*, 18*a* is defined by the extension of the respective longitudinal recesses 24, 26 in the respective guide direction 25*a*, 29*a*. In this respect, as illustrated in FIG. 1, the clamping jaw 16 is in a position for thick boards and the clamping jaw 18 in a position for thin boards, wherein the clamping jaws 16, 18 are movable from the initial position 16', 18' to the end position 16, 18 due to the clamping stroke in clamping direction determined by the guide means 25, 29.

In addition, an off-center clamping is possible in that, as illustrated in FIG. 1, the clamping jaw 18 is in the position for thin workpieces while the clamping jaw 16 is in the position for thick workpieces.

In FIG. 2, it is apparent, in addition, that the clamp body 14, designed as a bridge, embraces the respective clamping jaws 16 and 18 with two side arm parts 14*bo* and 14*bu* extending parallel to one another on opposite sides and, in addition, the displacement element 12 is designed as a housing, the side arms 12*b* of which comprise a lower arm part 50 and an upper arm part 52 which engage over the side arms 14*b* of the clamp body 14 likewise on their sides located opposite the clamping jaws 16, 18 and guide not only the guide bolts 37, 32 but also the aligning bolts 34, 36, wherein the aligning bolt 34 is provided with a milled edge 40 in addition to the head 38.

Figure 3:
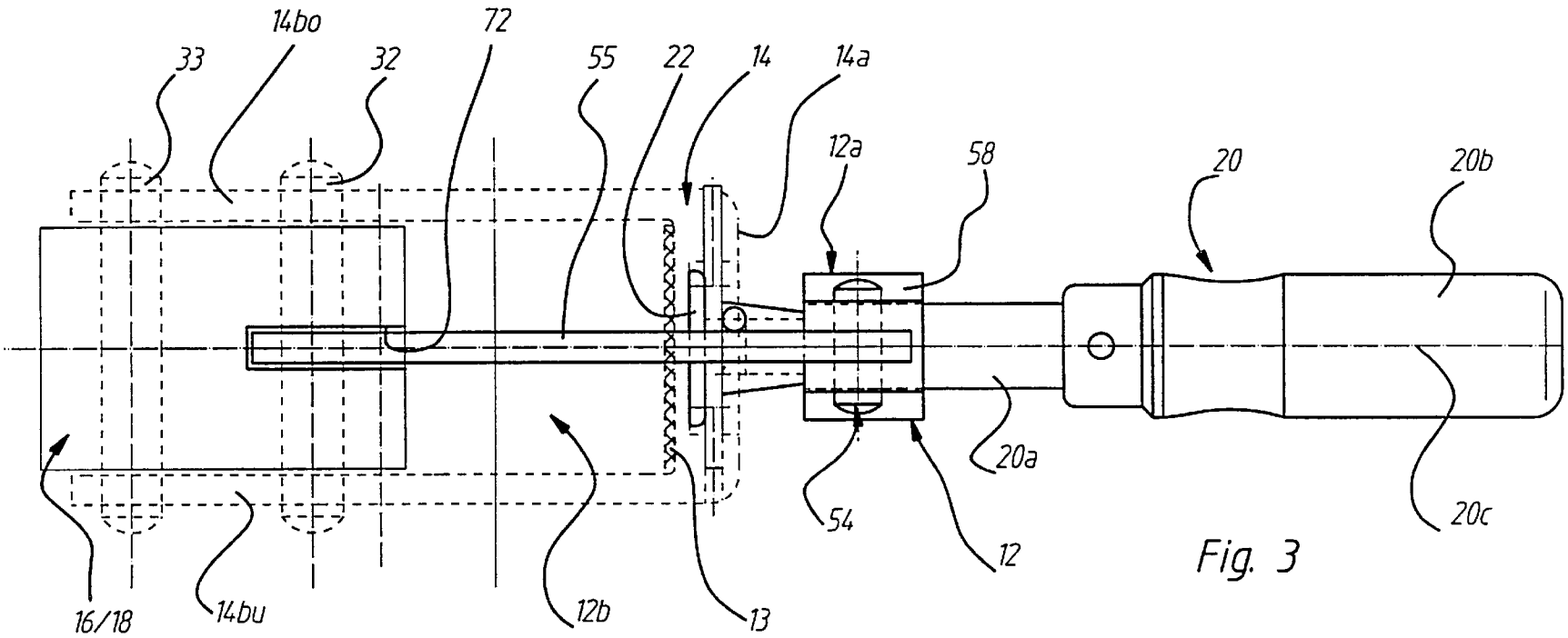
FIG. 3 shows a side view of a second embodiment.

Alternatively thereto, it is likewise conceivable, in a further embodiment illustrated in FIG. 3, to design the displacement element 12 such that its side arms 12*b* are to be formed from a flat material part 55 and are connected to a pin 54 with a transverse arm 12*a*. In this case, the side arms 12*b* consisting of the flat material part 55 extend in a slot 72 in the respective clamping jaw 16, 18 and have the longitudinal recess 28 and 30, respectively, which is penetrated by the respective guide bolts 37 or 32 and the respective aligning bolts 34, 36.

Figure 4:
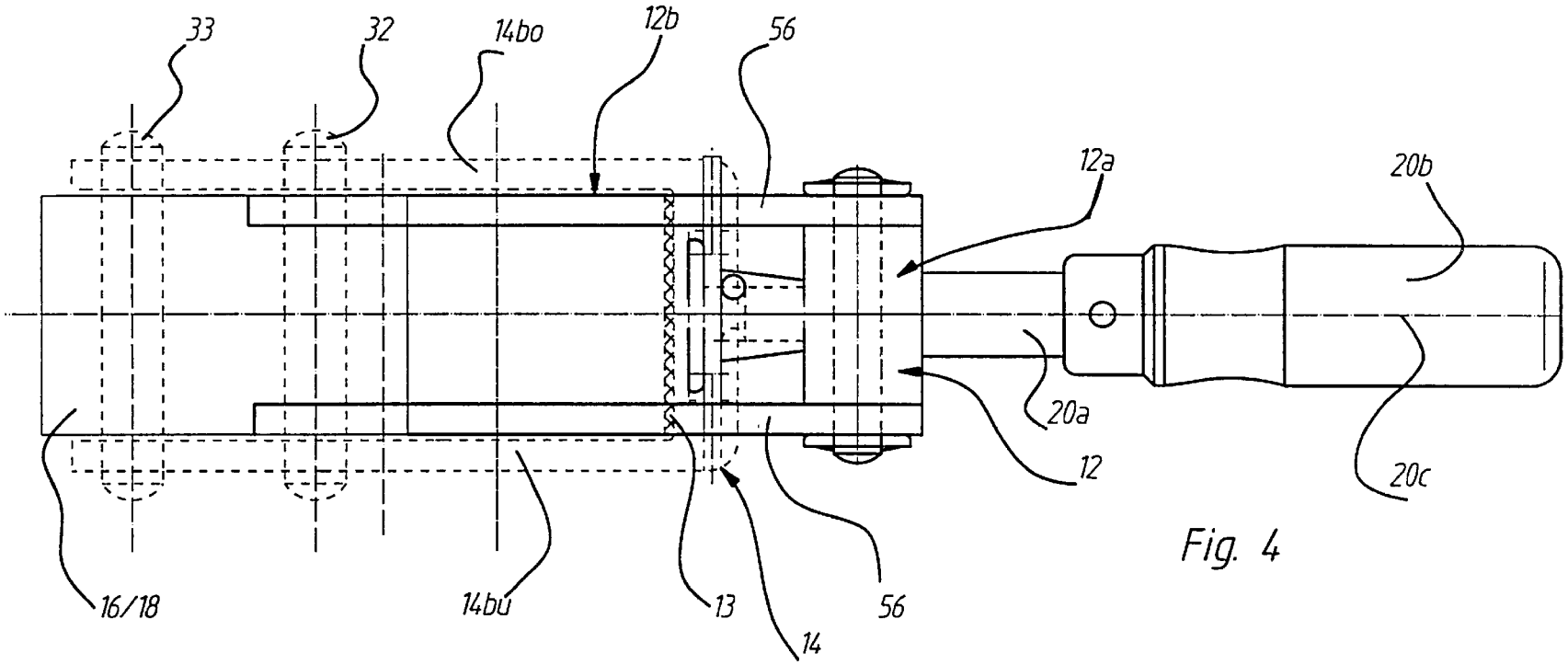
FIG. 4 shows a side view of a third embodiment.

In a further embodiment illustrated in FIG. 4, both side arms 12*b* of the displacement element 12 are designed as flat material parts or tongues 56 which engage between the respective clamping jaws 16, 18 and the side arm parts 14*bo* and 14*bu* and abut on opposite sides of the respective clamping jaws 16, 18.

As for the rest, all those parts of the second and third embodiments, illustrated in FIGS. 3 and 4, which are identical to those of the first embodiment have been given the same reference numerals and so reference is made in full to the explanations concerning the first embodiment with respect to the description thereof.

Figure 5:
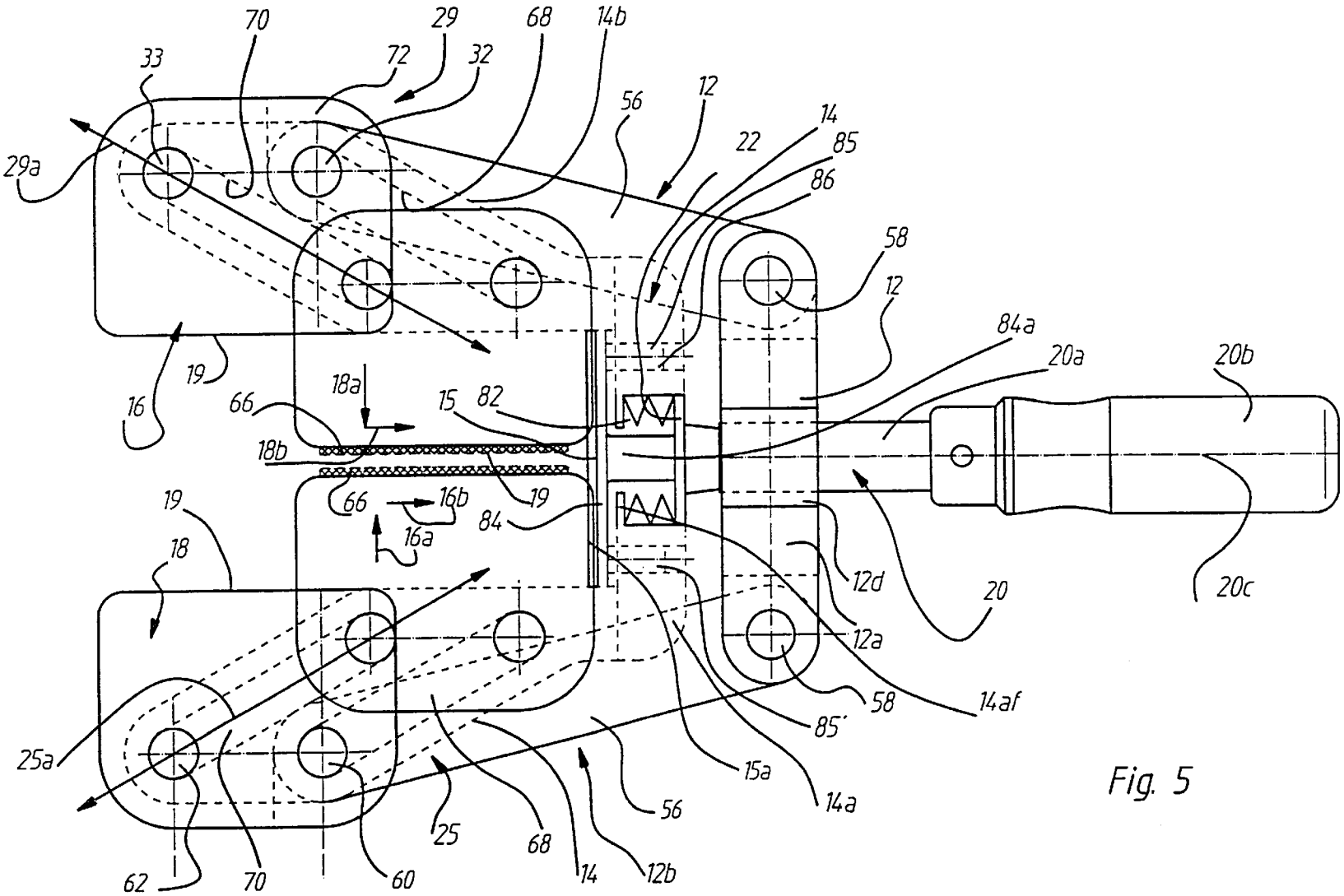
FIG. 5 shows a plan view similar to FIG. 1 of a fourth embodiment.

In a fourth embodiment, illustrated in FIG. 5, those parts which are identical to those of the first, second or third embodiments have been given the same reference numerals and so reference can likewise be made to the explanations concerning these embodiments with respect to the description thereof.

In the fourth embodiment, the side arms 14*b* of the clamp body 14 are designed such that the guide means 25, 29 each have two longitudinal recesses 68, 70 which extend parallel to one another and which both extend parallel to the guiding directions 25*a* and 29*a*, respectively. Furthermore, each of the clamping jaws 63, 65 is provided with two guide bolts 60, 62 which engage in the corresponding longitudinal recesses 68, 70 and are guided in these in the corresponding guiding direction 25*a* or 29*a*.

The connection between the transverse arm 12*a* of the displacement element 12 and the clamping jaws 63, 65 is thereby provided by the side arms 12*b* which have two flat material parts 56 extending parallel to one another in accordance with the third embodiment, these parts abutting on both sides of the respective clamping jaw 16 and 18 and each engaging articulatedly on the guide bolt 60 facing the transverse arm 12*a*. Furthermore, the side arms 12*b* are articulately connected to the transverse arm 12*a* via joint bolts 58.

Alternatively thereto, it would, however, also be conceivable to design the side arms 12*b* in accordance with the second embodiment.

As a result of the design of the guide means 25 and 29 using two longitudinal recesses 68, 70, a guidance of the clamping jaws 63, 65 in the respective guiding direction 25*a* and 29*a* is ensured, on the one hand, and, in addition, a defined alignment of the respective clamping jaws 16 and 18 relative to one another, particularly such that their clamping surfaces 19 always extend essentially in parallel alignment to one another and thus the clamping jaws 63, 65 are movable in the guide means 25, 29 over the entire clamping stroke in a manner secured against tilting.

In this respect, the extension of the longitudinal recesses 68, 70 in the respective guiding direction 25*a*, 29*a* is selected such that an adequate clamping stroke can be realized for the different thicknesses of the workpiece 27.

In order to make an elastic force available during the clamping of the workpiece 27, a set of springs 82 is provided in the case of the fourth embodiment, illustrated in FIG. 5, between the pressure part 22 and a flange 14*af* of the center part 14*a* and this set of springs endeavors to act on the flange 14*af* in the direction of the workpiece 27 away from the pressure part 22.

Furthermore, the edge pressure element 84 is supported on the pressure part 22 with a foot 84*a*, around which the set of springs 82 is arranged. The foot 84*a* thus represents a rigid connection between the pressure part 22 and the edge pressure element 84 with the edge pressure surface 15.

Furthermore, the spindle nut 12*d* is securely anchored in the transverse arm 12*a* so that during a rotation of the spindle 20 in such a manner that the pressure part 22 thereof is moved in the direction of the workpiece 27 and away from the transverse arm 12*a* a movement of the transverse arm 12*a* relative to the center part 14*a* can be generated such that the clamping jaws 63, 65 are moved, in the manner described in conjunction with the first three embodiments, in the direction of the workpiece in the clamping directions 16*a*, 18*a* and at the same time in the transverse directions 16*b*, 18*b* and for such a time until the workpiece 27 is clamped between the clamping surfaces 19 of the clamping jaws 63, 65. If, in this case, the spindle is turned further, the pressure part 22 acts on the set of springs 82 in the sense that this is pressed together between the pressure part 22 and the flange 14*af* of the center part 14*a* and the edge pressure element 84, which is a part separate from the center part 14*a*, can be moved in addition in the direction of the workpiece 27 via the foot 84*a*, wherein at the same time the effect occurs that the set of springs 82 generates an elastic force which keeps the workpiece constantly clamped between the clamping jaws 16 and 18.

In order to bring about a defined movability of the edge pressure element 84 relative to the center part 14*a*, it is preferably provided for the edge pressure element 84, designed in the simplest case as a plate, to be guided by means of guide pins 85 engaging in guide bores 86 in the center part 14*a*, wherein the guide pins 85 are securely connected to the edge pressure element 84.

It is also preferably provided in this embodiment for a pad 15*a* consisting of a soft elastic material to be arranged on the edge pressure surface 15.

All the clamping jaws 16, 18 are preferably provided with pliant pads 66 which are produced from an elastomeric material so that an additional stroke with the spindle 20 can be generated during abutment on the respective side of the workpiece to be clamped and this additional stroke leads to a compression of the pad which makes generation of an additional pressure on the edge part possible.

The inventive construction according to the first four embodiments likewise makes it possible, due to the automatic opening of the clamping jaws, not to damage the corners of the edges of the workpiece or the board or also to engage over projecting edge part pieces.

The shape of the clamping jaws 16, 18 can, in addition, be of any optional design and also be provided with optionally large clamping surfaces.

A fifth embodiment of an inventive edge clamp, illustrated in FIGS. 6 to 15, likewise comprises a clamp body 14, on the side arms 14*b* of which guide means 25, 29 are provided, with which, however, the guiding directions 25*a*, 29*a* extend such that the clamping jaws 16, 18 move away from the center part 14*a* during a movement in the clamping direction 16*a*, 18*a* towards one another and so a movement in the transverse direction 16*b*, 18*b* leads away from the center part 14*a*.

The guide means 25, 29 are, in principle, of exactly the same construction as in the fourth embodiment, illustrated in FIG. 5, i.e. each of the guide means 25, 29 has two longitudinal recesses 68, 70 extending parallel to one another but with the difference that the longitudinal recesses 68, 70 extend parallel to the guiding directions 25*a*, 29*a* which have a different alignment.

In these guide means 25, 29, the clamping jaws 16, 18 are, as in the third embodiment, guided with guide bolts 60, 62 and thus movable in the guiding directions 25*a*, 29*a* in the manner described.

Figure 6:
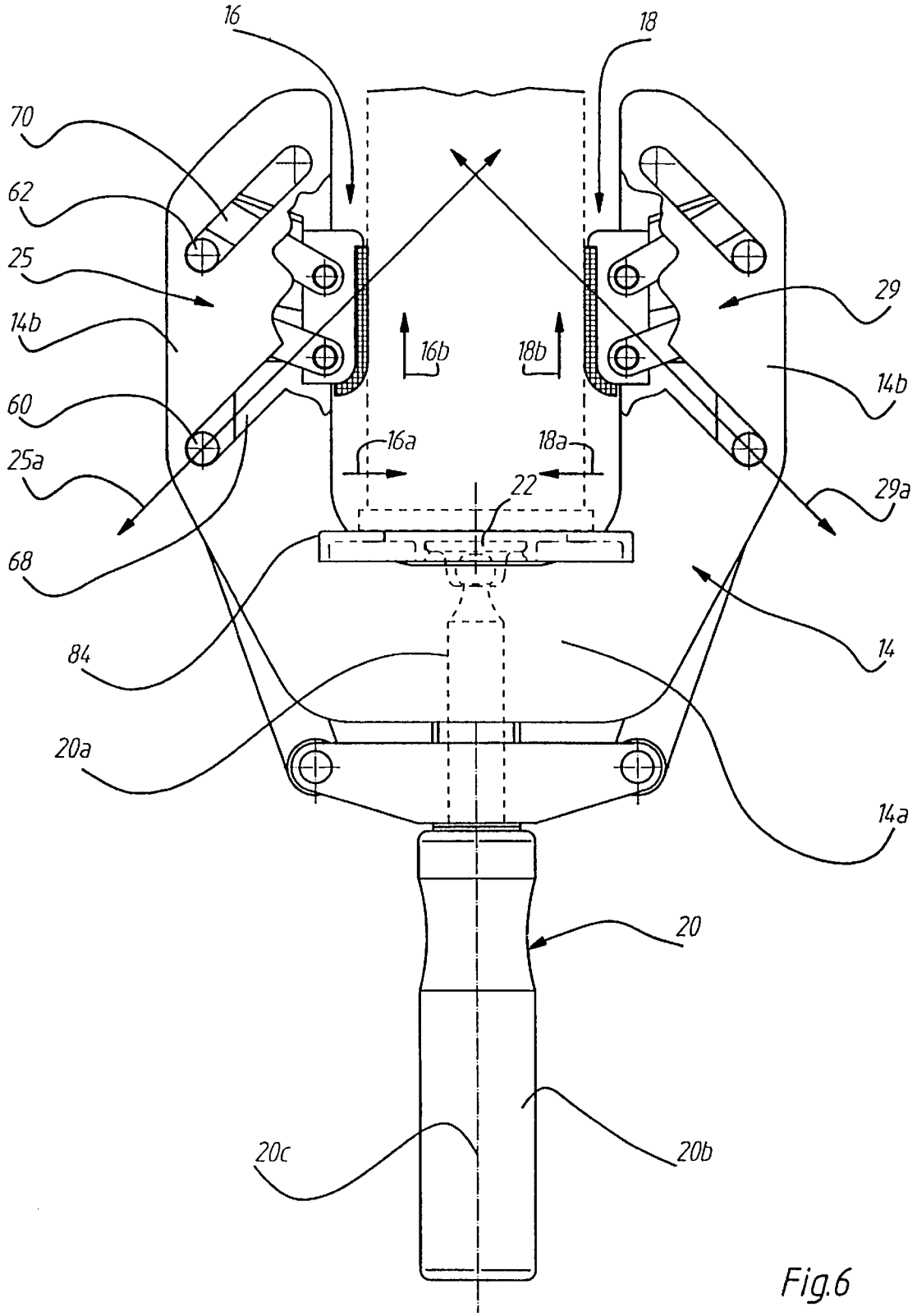
FIG. 6 shows a plan view similar to FIG. 1 of a fifth embodiment.
Figure 7:
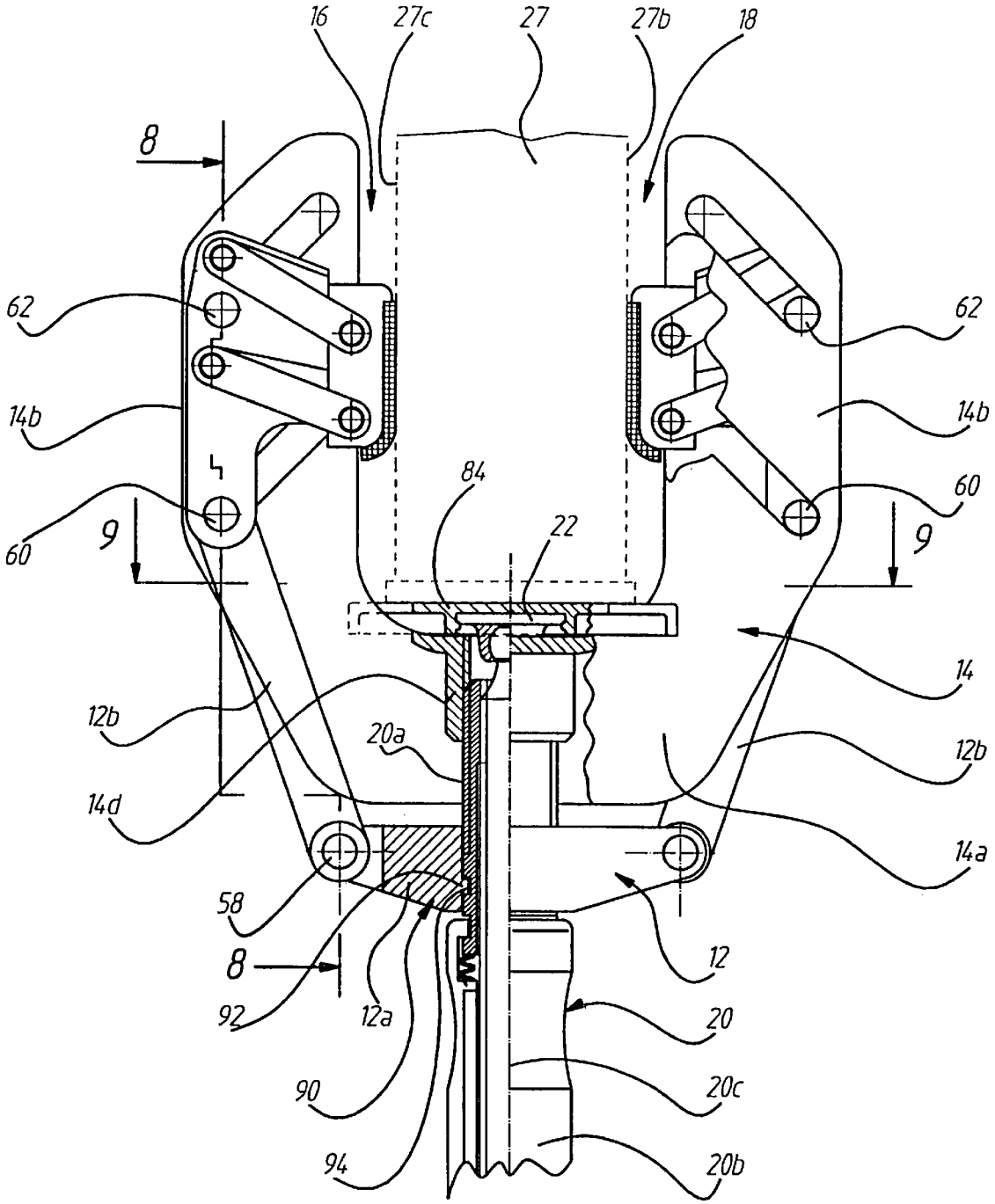
FIG. 7 shows a plan view of the fifth embodiment similar to FIG. 6 with a spindle illustrated partially cut open.
Figure 8:
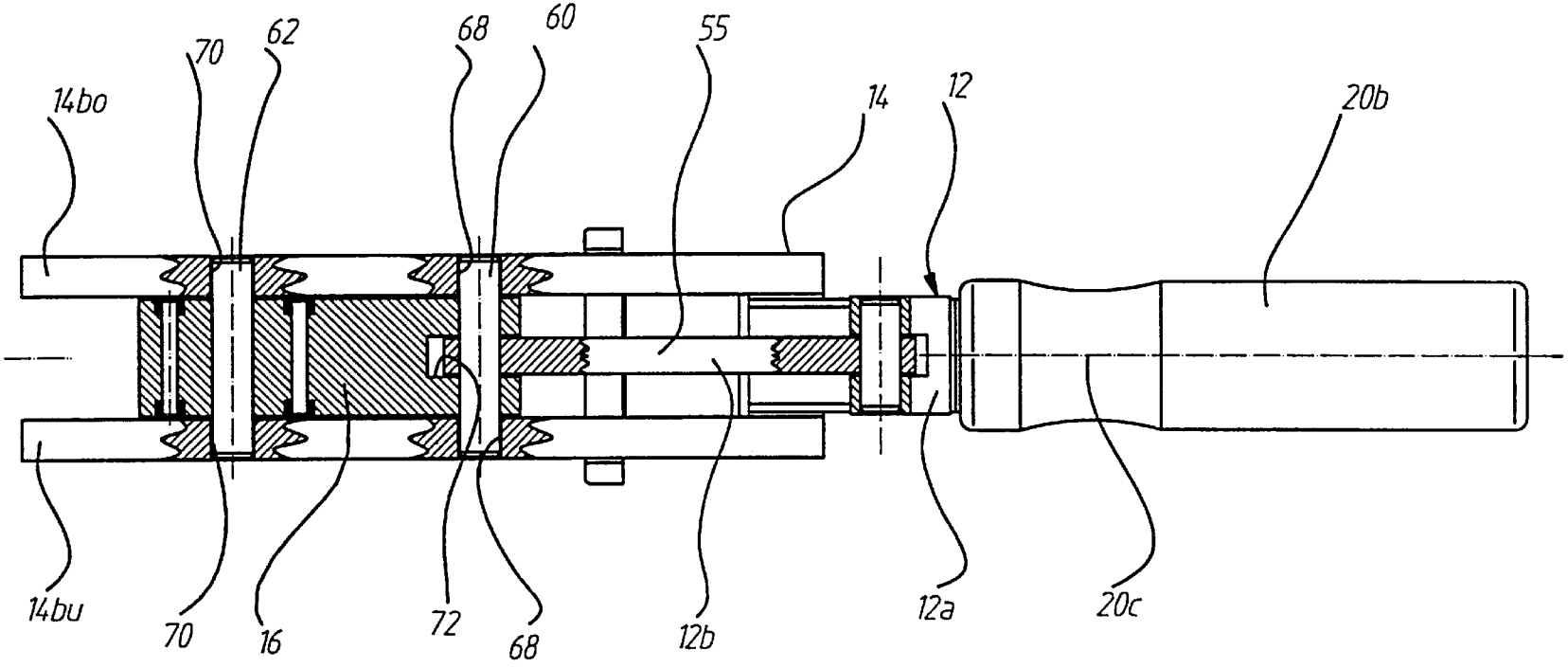
FIG. 8 shows a section along line 8—8 in FIG. 7.
Figure 9:
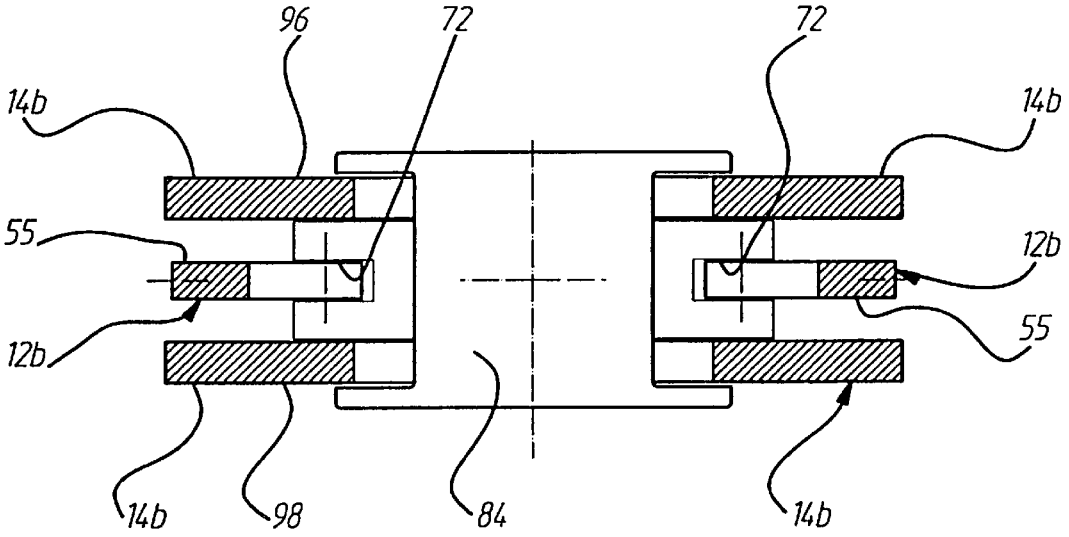
FIG. 9 shows a section along line 9—9 in FIG. 7.

Furthermore, as illustrated in FIGS. 6 to 8, the displacement element 12 with the transverse arm 12*a* and the side arms 12*b* is designed such that the side arms 12*b* are connected to the transverse arm 12*a* via joints 58 and, in addition, each engage on the guide bolt 60 of the respective clamping jaws 16, 18.

For this purpose, as illustrated in FIG. 8, the respective clamping jaw 16 is provided with the slot 72 in the same way as that illustrated in conjunction with the second embodiment, wherein the side arms 12*b* are preferably formed from flat material parts 55, as likewise explained in conjunction with the second embodiment according to FIG. 3.

In order to adjust the transverse arm 12*a*, this is connected to the spindle 20 via an axial bearing 90 so as to be non-displaceable in the direction of the spindle axis 20*c*. The axial bearing 90 has an annular flange 92 which is integrally formed on the transverse arm 12*a*, engages in a groove 94 in the spindle 20 and thus allows a rotation of the spindle 20 relative to the transverse arm 12*a* but no axial displacement thereof.

Furthermore, the spindle 20 extends with its threaded section 20*a* in a spindle nut 14*d* which is integrally formed onto the center part 14*a* of the clamp body 14. When the spindle 20 is turned by means of the turning handle 20*b*, the spindle 20 can thus be screwed into the spindle nut 14*d* with its threaded section 20*a* and the transverse arm 12*a* is therefore movable in the direction of the center part 14*a*, whereby in the position of the guiding directions 25*a*, 29*a* provided in this embodiment a displacement of the clamping jaws 16, 18 in the direction towards one another takes place in order to clamp the workpiece 27 on the upper side 27*b* and the underside 27*c* by means of the clamping jaws 16, 18.

In this respect, the side arms 12*b* of the displacement element 12 displace the clamping jaws 16, 18 along the guide means 25, 29.

With respect to the actuation of the clamping jaws 16, 18, the operation is similar to that of the fourth embodiment, illustrated in FIG. 5, with the difference that the transverse arm 12*a* is moved by the spindle in the direction of the center part 14*a* and the side arms 12*b* act as pressure arms on the clamping jaws 16, 18.

As a result of the orientation of the guiding directions 25*a*, 29*a* selected in this fifth embodiment, the workpiece 27 is displaced slightly away from the center part 14*a* during the clamping of the workpiece on account of the movement of the clamping jaws 16, 18 in the transverse directions 16*b* and 18*b* and not towards it as in the fourth embodiment illustrated in FIG. 5.

Furthermore, in the same way as in the fourth embodiment the edge pressure element 84 is designed as a separate part which is movable relative to the center part 14*a* of the clamp body 14.

In this respect, the edge pressure element 84 is preferably designed in the form of a molded part which engages over the clamp body 14 on its upper side 96 and its underside 98, is thereby guided so as to be non-rotatable relative to the clamp body 14 and is movable in the direction of the spindle axis 20*c* relative to the center part 14*a* of the clamp body 14.

Figures 10, 11, 12:
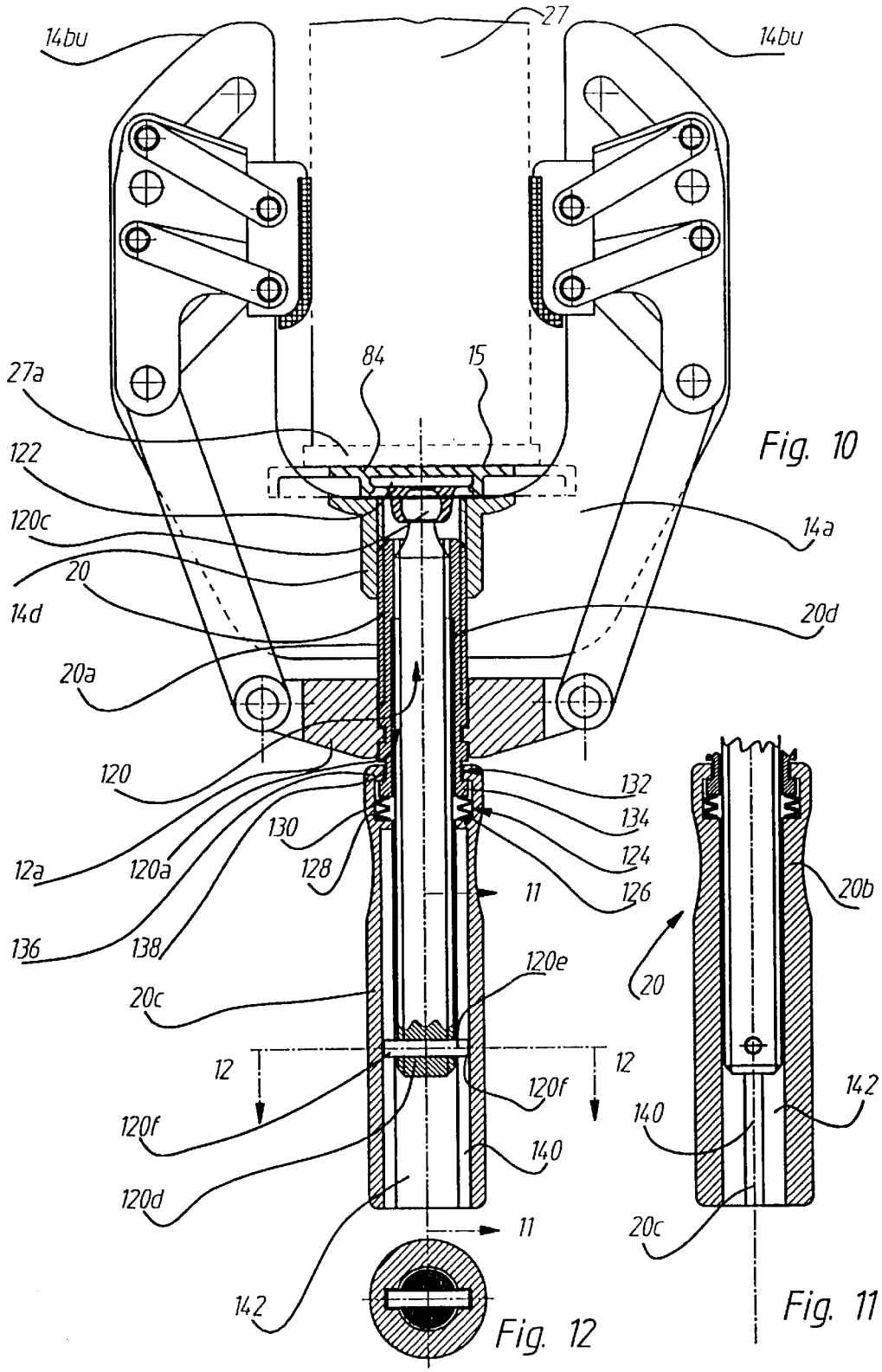
FIG. 10 shows a plan view similar to FIG. 6 with a spindle completely cut open in the plane of drawing.
FIG. 11 shows a section along line 11—11 in FIG. 10.
FIG. 12 shows a section along line 12—12 in FIG. 10.

To displace the edge pressure element 84, the spindle 20 is designed as a hollow spindle or outer spindle, in which, as illustrated in FIGS. 10 and 11 and 12, a second spindle 120 ("cocking spindle") is arranged which has an outer threaded section 120*a* engaging in an inner thread 20*d* of the spindle 20. The second spindle 120 bears at its front end 120*c* a pressure plate 122 which is securely connected to the edge pressure element 84 and is connected to the front end 120*c* of the second spindle 120 so as to be rotatable but axially non-displaceable.

In contrast to the preceding embodiments, the first spindle 20 is not rigidly connected to the turning handle 20*c* but via a frictional slip coupling 124 which is formed, for example, by a biased set of springs 126 which is supported, on the one hand, on a flange surface 128 of the turning handle 20*b* and, on the other hand, on a flange surface 130 of the spindle 20 and is biased against both flange surfaces 128, 130. For this purpose, the turning handle 20*c* is preferably mounted on one end 134 of the spindle 20 by means of an axial bearing 132, wherein the axial bearing 132 preferably has a collar 136 which engages in a groove 138 in the region of the end 134 of the spindle 20.

On the other hand, the second spindle 120 is connected to the turning handle 20*b* with an end 120*d* located opposite the end 120*c* so as to be non-rotatable but axially displaceable. For this purpose, the end of the second spindle 120 is penetrated, for example, by a transverse bolt 120*e* which engages with its outer ends 120*f* in longitudinal grooves 140 extending parallel to the spindle axis 20*c* in an inner wall 142 of the hollow turning handle 20*b*.

The actuation of the two spindles 20 and 120 takes place such that for the opening of the clamping jaws 16, 18 the spindle 20 is turned by means of the turning handle 20*b* such that the transverse arm 12*a* is moved away from the center part 14*a*. This is possible for such a time until the guide bolts 60, 62 abut on the outer ends of the longitudinal recesses 68, 70. In this position, the threaded section 20*a* of the spindle 20 is still in engagement with the spindle nut 14*d* which is securely seated on the center part 14*a* of the clamp body 14. A further opening of the clamping jaws 16 and 18 is thus no longer possible and therefore the spindle 20 can also no longer be turned. If, in this position, the second spindle 120 is still not in its position completely turned into the first spindle 20, a further turning of the turning handle 20*b* is possible by overcoming the friction of the coupling 124 and thus a further turning of the second spindle 120 since this is connected non-rotatably to the turning handle 20*b* via the transverse bolt 120*e*. As a result of the further turning, the outer thread 120*a* of the second spindle 120 is screwed further in the inner thread 20*d* of the first spindle 20 and moves the edge pressure element 84 to such an extent in the direction of the center part 14*a* until the edge pressure element 84 abuts, for example, on the center part 14*a*. In this position, the second spindle 120 is also no longer rotatable and thus the turning handle 20*b* is also blocked against any further turning.

If the edge clamp is now placed against the workpiece 27 in accordance with the fifth embodiment, the first spindle 20, the threaded section 20*a* of which is screwed into the spindle nut 14*d* and thus moves the transverse arm 12*a* in the direction of the center part 14*a* of the clamp body 14, is actuated first of all in reverse direction via the coupling 124 as a result of turning of the turning handle 20*b*. As a result, the side arms 12*b* slide the clamping jaws 16, 18 along the guiding directions 25*a*, 29*a* in the guide means 25, 29 to such an extent until these abut on the upper side 27*b* and the underside 27*c* of the workpiece 27 on account of their movement in the clamping direction 16*a*, 18*a*. On account of the abutment of the clamping jaws 16, 18, any further turning of the spindle 20 is blocked.

During this displacement of the clamping jaws 16, 18 in the clamping direction 16*a*, 18*a*, a displacement of the edge pressure element 84 in the direction of the workpiece 27 with the edge part 27*a* is already initiated at the same time in accordance with the displacement of the first spindle 20 relative to the spindle nut 14*d*, wherein the edge part 27*a* has not yet been firmly pressed on the workpiece 27 since this is not yet clamped between the clamping jaws 16, 18 during the displacement thereof and is fixed in position relative to the clamping jaws 16, 18 only during clamping. As a result of the blocking of the turning of the spindle 20 on account of the firm clamping of the workpiece 27 between the clamping jaws 16, 18, a further turning of the second spindle 120 relative to the first spindle 20 is now possible by means of the turning handle 20*c* by overcoming the friction of the coupling 124, wherein an additional clamping distance of the edge pressure element 84 may be realized thereby, irrespective of the position of the edge part 27*a*, and this is limited only by the path of displacement of the second spindle 120 relative to the first spindle 120. For example, in this case a subsequent pressing of the edge part 27*a* may be realized without the edge pressure element 84 abutting on the edge part 27*a* prior to the clamping of the workpiece 27 between the clamping jaws 16, 18 due to movement of the edge pressure element 84 over a longer distance which takes place merely due to movement of the second spindle 120 relative to the first spindle 20 blocked in its rotation.

Figure 13:
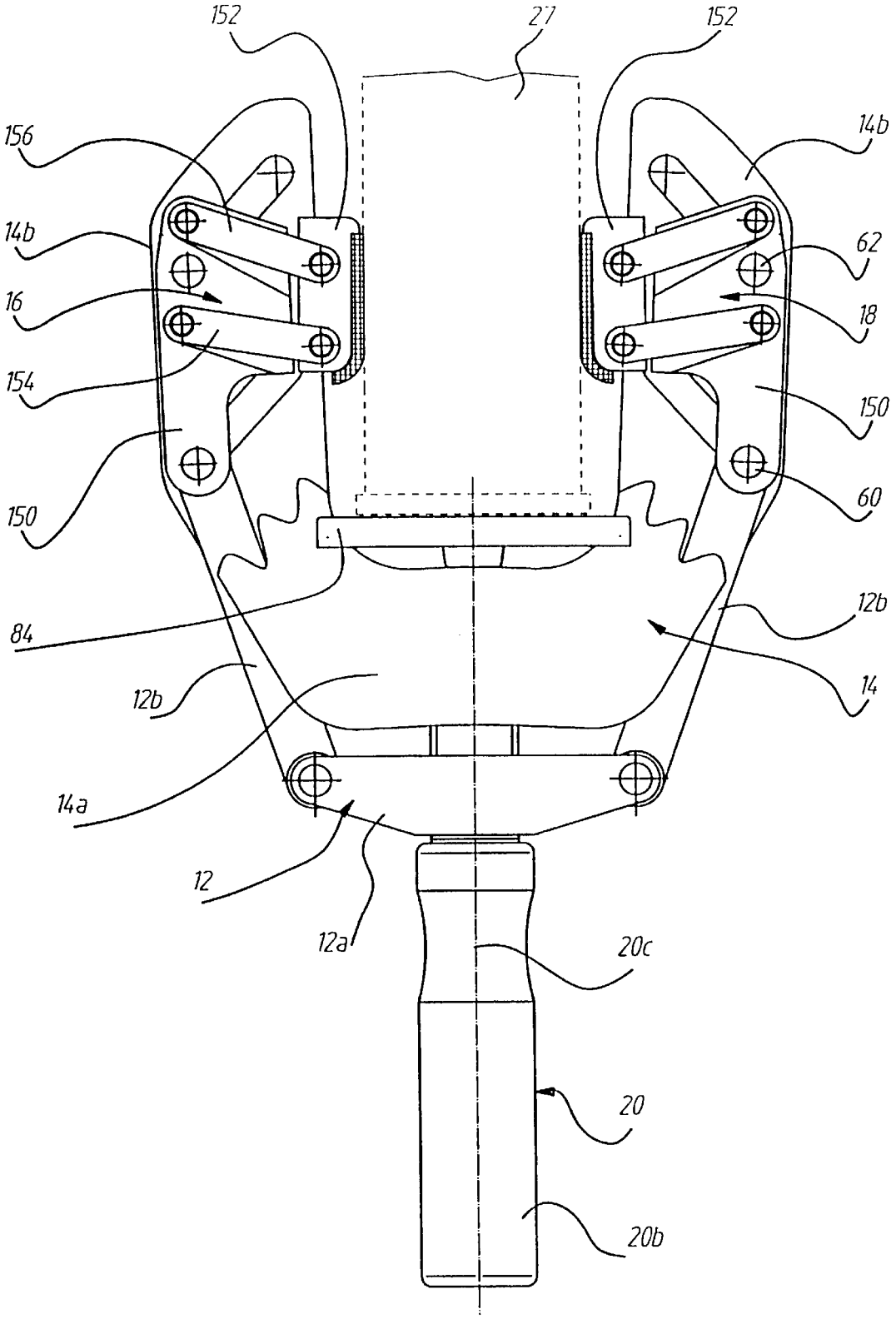
FIG. 13 shows a plan view similar to FIG. 6 with a clamped workpiece and, in contrast to FIG. 10, side arms of a clamp body bent apart.
Figure 15:
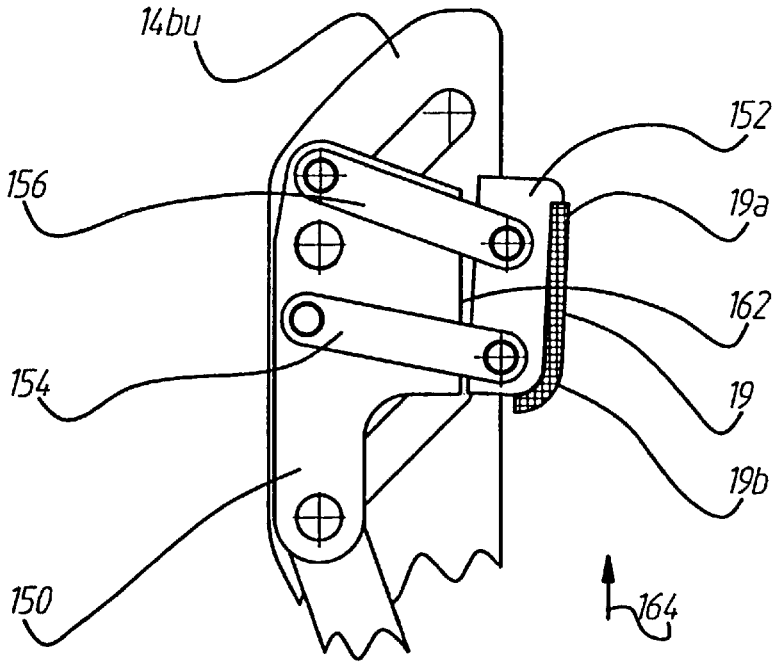
FIG. 15 shows an illustration similar to FIG. 14 with a clamping surface support lifted away from the clamping jaw member, similar to FIG. 13
Figure 14:
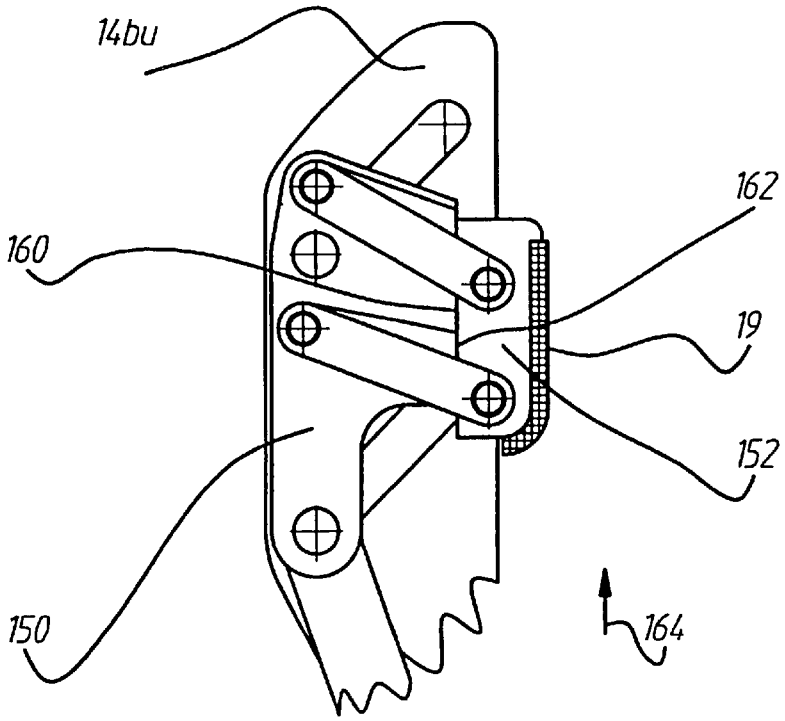
FIG. 14 shows an illustration of a detail of a clamping jaw with clamping jaw member and clamping surface support abutting thereon, similar to FIG. 10.

In contrast to the embodiments presented thus far, the clamping jaws 16, 18 are, as illustrated in FIG. 10 as well as FIGS. 13 to 15 in detail, designed in several parts.

These comprise a clamping jaw member 150 which supports the guide bolts 60, 62 and is guided in the guide means 25, 29 in the side arms 14*b* of the clamp body 14.

In addition, the clamping jaws 16, 18 comprise in the case of the fifth embodiment a clamping surface support 152 which is movable relative to the clamping jaw members 150 and is mounted on the clamping jaw member 150 by means of swivel guide bars 154, 156. The swivel guide bars 154, 156 are not designed as parallelogram guide bars but have a slight deviation from a parallel orientation. As a result of this deviation from the parallel orientation the clamping surface supports 152 abut with their rear side 160 on a contact surface 162 of the clamping jaw members 150 in their position abutting on the clamping jaw members 150, illustrated in FIG. 14, and in this position are oriented parallel to one another with their clamping surfaces 19.

In addition, the clamping surfaces 19 are oriented at a first angle to the contact surface 182, preferably parallel to it.

If the clamping surface supports 152 are now moved away from the clamping jaw members 150 under guidance of the swivel guide bars 154, 156, as illustrated in FIG. 15, this leads, on account of the deviating arrangement of the swivel guide bars 154, 156 from a parallelogram guide bar arrangement, to the fact that the clamping surfaces 19 form with the contact surfaces 162 a second angle which is greater than the first angle. For example, and proceeding from a parallel arrangement of the clamping surfaces 19 in relation to the contact surfaces 162 and thus from a first angle of 0°, the angle between the clamping surface 19 and the contact surface 162 is greater than 0° and, in particular, the clamping surfaces 19 extend such that their regions 19*a* remote from the center part 14*a* are located closer to one another than the regions 19*b* (FIG. 15) insofar as no deformation takes place in the region of the side arms 14*b* during the clamping of the workpiece. Since, however, the clamp body 14 cannot normally be designed with such a rigidity that the side arms 14*b* do not move apart from one another during the clamping of the workpiece 27 by means of the clamping jaws 16, 18, the lifting of the clamping surface supports 152 away from the clamping jaw members 150 and the tilting of the clamping surfaces 19 caused thereby can be used to compensate essentially for any widening of the side arms 14*b*.

However, the clamping surface supports 152 lift away from the clamping jaw members 150 only under increased pressure exerted by the edge pressure element 84 on the workpiece 27 which then has the tendency to move away from the center part 14*a* of the clamp body and thus likewise take along the clamping surface supports 152 in this direction since these abut non-positively on the workpiece 27.

For this reason, the swivel guide bars 154 and 156 are arranged such that the clamping surface supports 152, in their position abutting on the clamping jaw members 150, illustrated in FIG. 14, are in their maximum position facing the center part 14*a* and a lifting of the clamping jaw members 150 takes place when the clamping surface supports 152 are caused by the workpiece 27 to move in a direction 164 away from the center part 14*a*, wherein this lifting of the clamping surface supports 152 leads to an additional, secure clamping of the workpiece 27 and at the same time—as already described—can be used to compensate for the widening of the side arms 14*b* of the clamp body 14 caused by an increased clamping of the workpiece 27 (FIG. 13).

As for the rest, those parts of the fifth embodiment which are identical to those of the preceding embodiments are given the same reference numerals and so reference is made in this respect to the explanations concerning these embodiments.

In a sixth embodiment of the inventive edge clamp which represents a variation of the fifth embodiment, the turning handle 20*b* is provided with a handle sheath 170 and a handle sleeve 172. The second spindle designed as inner spindle is arranged in the turning handle 20*b*, i.e., in particular, within the handle sheath 170 and the handle sleeve 172, so as to be adjustable; it runs in the inner thread 20*d* serving as nut thread of the first spindle 20 serving as outer spindle. The first spindle 20 runs in the nut thread of the spindle nut 14*d* of the clamp body 20. The transverse arm 12*a* of the displacement element 12 is adjustable with the outer spindle or first spindle 20, wherein the side arms 12*d* of the displacement element 12 are mounted on the transverse arm 12*a*, act as push rods and are connected to the clamping jaw members 150 of the clamping jaws 16, 18. In the same way as in the fifth embodiment, the two swivel guide bars 154, 156 are mounted in swivel bearings 150*a*, 150*b* on the clamping jaw member 150 and in swivel bearings 152*a* and 152*b* on the clamping jaw support 152.

The pressure part 122 is, in this embodiment, mounted by a ball 180 integrally formed at the end 120*c* of the second spindle 120, wherein the ball 180 allows tilting of the pressure part 122 relative to the spindle axis 120*c* and thus also a tilting of the edge pressure element 84 in relation to the spindle axis 20*c*. In order to avoid any turning of the edge pressure element 84 about the spindle axis 20*c* and thus a relative rotation of the edge pressure element 84 with respect to the edge part 27*a*, the edge pressure element 84 is provided with lateral vanes 182 which engage over the clamp body 14 on its outer sides and thus secure it against any rotation. Furthermore, the edge pressure element 84 is preferably clipped onto the pressure part 122. The edge pressure element 84 thus forms an enlarged pressure surface for abutting the edge part 27*a* on the workpiece 27 which, in addition, is secured against any rotation.

Figure 16:
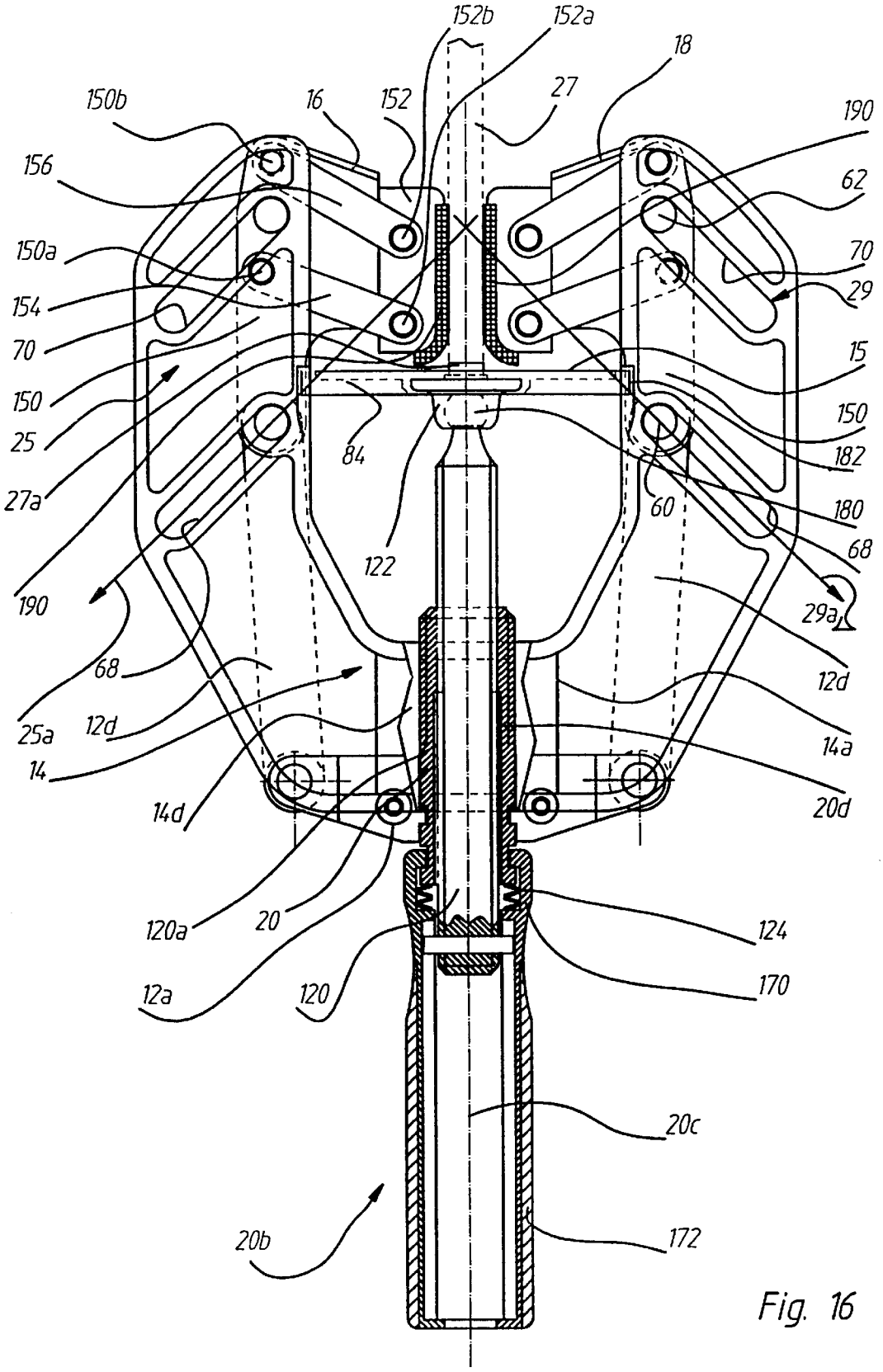
FIG. 16 shows a plan view similar to FIG. 1 of a sixth embodiment illustrated partially cut open.

In conjunction with the sixth embodiment according to FIG. 16, the first spindle 20 or outer spindle is, in particular, turned fully into the spindle nut 14*d* and, in addition, the second spindle or inner spindle 120 is essentially fully extended, i.e. the edge pressure element 84 has the essentially maximum possible distance from the center part 14*a* of the clamp body 14.

With this embodiment, the clamping of a narrow workpiece 27, in particular, is shown, with which the maximum stroke of the clamping jaws 16, 18 in the clamping directions 16*a*, 18*a* is more or less required in order to clamp the workpiece 27 securely, wherein the differences in stroke result from a comparison of the illustration of the sixth embodiment according to FIG. 16 with, for example, FIG. 10 in conjunction with the fifth embodiment.

The clamping position of the sixth embodiment illustrated in FIG. 16 is achieved in that the inventive edge clamp is held by the turning handle 20*b*. With clamping jaws 16, 18 open, a workpiece in the form of a board is held between the clamping jaws 16, 18 and then a rotation first of all of the outer spindle or first spindle 20 together with the inner spindle or second spindle 120 in the spindle nut 14*d* is brought about due to turning of the turning handle so that the transverse arm 12*a* of the displacement element 12 is moved in the direction of the center part 14*a*.

The transverse arm 12*a* is preferably designed as two shells in order to realize in a simple manner the axial bearing 90 explained in conjunction with the fifth embodiment for the connection between the spindle 20 and the transverse arm 12*a*.

During this rotation of the outer spindle or first spindle 20, the side arms 12*b* push the clamping jaws 16, 18 on each side along the guide means 25, 29 in the guiding directions 25*a*, 29*a* until the clamping surfaces 19, which are preferably provided with soft material pads 190, abut securely on the workpiece 27. As a result of the antislip soft material pads 190, the hold of the clamping surface 19 on the upper side and underside of the workpiece is improved.

As a result of the increased clamping force, a further rotation of the outer spindle or first spindle 20 is blocked and so a further turning of the turning handle 20*b* is possible by overcoming the friction of the coupling 124, explained in conjunction with the fifth embodiment, and a rotation of the inner spindle or second spindle 120 is brought about via the transverse bolt 120*e*, whereby the second spindle turns out of the first spindle 20 or outer spindle and moves the pressure part 122 in the direction of the workpiece for such a time until this acts with the edge pressure surface 15 on the edge part 27*a* and exerts pressure on this.

As a result of the swivelability of the clamping jaw supports 152 with the clamping surfaces 19 and the antislip pads 190, the clamping surface supports 152 lift away from the clamping jaw members 150 during the pressure of the edge pressure element 84 acting on the edge part 27*a* and thus on the workpiece, in the same way as in the fifth embodiment, and this leads to a reinforcement of the clamping force acting on the workpiece 27 by way of the clamping jaws 16, 18, wherein at the same time, in the same way as explained in the fifth embodiment, a widening of the side arms 14*b* of the clamp body 14 can be compensated on account of the not quite parallel guidance of the swivel guide bars 154, 156 and so, when the clamping jaw supports 152 lift further away from the clamping jaw members 150 and as a result the side arms 14*b* bend out relative to one another, the deviation of the clamping surfaces 19 from a parallel alignment occurring as a result can be compensated and so despite any bending out of the side arms 14*b* the clamping surfaces 19 remain essentially parallel to one another or also, for example, in relation to the spindle axis 20*c* on account of the action of the swivel guide bars 154, 156 and thus abut on the workpiece 27 essentially over their entire surface.

What is claimed is:

1. An edge clamp, comprising:

a clamp body, said clamp body being of an approximately C-shaped design adapted to engage a workpiece on an upper side with a first side arm and on an underside with a second side arm, a first clamping jaw adapted to abut on the upper side of the workpiece and a second clamping jaw adapted to abut on the underside of the workpiece for fixing the clamp body on the workpiece, a pressure element for generating clamping pressure to act upon an edge pressure element acting on an edge part, said pressure element being actuatable by means of an actuating element, and a guide provided in said clamp body arranged on the side arms, the clamping jaws being guideable along said guide for displacement towards one another and away from one another, a securing-in position of the clamp body on the workpiece being achievable by displacing the clamping jaws in the guide in a direction towards the workpiece.

2. An edge clamp as defined in claim 1, wherein the clamping jaws are movable in the guide means in a clamping direction towards the workpiece and at the same time in a transverse direction transversely to the clamping direction.

3. An edge clamp as defined in claim 2, wherein during a movement in the clamping direction the clamping jaws are additionally movable in the guide means in the direction of the transverse direction towards the edge pressure element.

4. An edge clamp as defined in claim 2, wherein during a movement in clamping direction the clamping jaws are additionally movable in the guide means in the direction of the transverse direction away from the edge pressure element.

5. An edge clamp as defined in claim 1, wherein the two guide means extend in guiding directions intersecting at an angle of less than 90°.

6. An edge clamp as defined in claim 1, wherein the clamping jaws are adapted to be fixed in position in the aligning elements so as to be aligned in several positions.

7. An edge clamp as defined in claim 1, wherein the clamping jaws have clamping jaw members guided in the guide means.

8. An edge clamp as defined in claim 7, wherein the clamping jaw members bear clamping surfaces.

9. An edge clamp as defined in claim 7, wherein clamping surface supports supporting clamping surfaces are held on the clamping jaw members.

10. An edge clamp as defined in claim 1, wherein the clamping surfaces bear elastic pads.

11. An edge clamp as defined in claim 10, wherein the pads comprise an elastomeric material.

12. An edge clamp as defined in claim 10, wherein the pads comprise a soft material pad.

13. An edge clamp as defined in claim 1, wherein the clamping surfaces bear pads adhering to the workpiece in a non-slip manner.

14. An edge clamp as defined in claim 1, wherein the clamp body bears the edge pressure element.

15. An edge clamp as defined in claim 1, wherein the edge pressure element is a part movable in relation to the clamp body.

16. An edge clamp comprising:

a clamp body, a first clamping jaw adapted to abut on an upper side of a workpiece and a second clamping jaw adapted to abut on an underside of the workpiece for fixing the clamp body on the workpiece, a pressure element for generating clamping pressure to act upon an edge pressure element acting on an edge part, said pressure element being actuatable by means of an actuating element, a guide provided in said clamp body, the clamping jaws being guideable along said guide for displacement towards one another and away from one another, and a clamping jaw actuator comprising a displacement element movable relative to the clamp body for actuating the clamping jaws, said clamping jaws being movable along the guide by interaction with said displacement element, a securing-in position of the clamp body on the workpiece being achievable by displacing the clamping jaws in the guide in a direction towards the workpiece.

17. An edge clamp as defined in claim 16, wherein the displacement element has a transverse arm movable relative to the clamp body by the means for actuating the clamping jaws and extending transversely to this, said transverse arm acting on the clamping jaws via side arms.

18. An edge clamp as defined in claim 17, wherein the side arms are rigidly connected to the transverse arm.

19. An edge clamp as defined in claim 17, wherein the side arms are articulatedly connected to the transverse arm.

20. An edge clamp as defined in claim 1, wherein the clamping jaws are guideable by an aligning element.

21. An edge clamp as defined in claim 20, wherein the displacement element is used for the aligning element.

22. An edge clamp as defined in claim 20, wherein the guide means are used for the aligning element.

23. An edge clamp as defined in claim 16, wherein the clamping jaw actuator comprises a displacement drive, the displacement element being movable by said displacement drive relative to the clamp body.

24. An edge clamp as defined in claim 23, wherein the displacement drive comprises an adjusting spindle which interacts with an axial bearing as a first point of force application and a spindle nut as a second point of force application.

25. An edge clamp as defined in claim 24, wherein one of the points of force application acts on the displacement element via an elastic element.

26. An edge clamp as defined in claim 23, wherein:

the pressure element comprises a cocking spindle, and the displacement drive comprises an adjusting spindle.

27. An edge clamp as defined in claim 26, wherein the cocking spindle acts directly on the edge pressure element.

28. An edge clamp as defined in claim 26, wherein the adjusting spindle and the cocking spindle are arranged coaxial to one another.

29. An edge clamp as defined in claim 28, wherein the cocking spindle is designed as an inner spindle in relation to the adjusting spindle and is displaceable in the direction of the spindle axis due to rotation relative to the adjusting spindle.

30. An edge clamp as defined in claim 29, wherein the cocking spindle is supported on the clamp body via the adjusting spindle.

31. An edge clamp as defined in claim 26, wherein an actuating element for the cocking spindle is mounted on the adjusting spindle so as to be rotatable.

32. An edge clamp comprising:

a clamp body, a first clamping jaw adapted to abut on an upper side of a workpiece and a second clamping jaw adapted to abut on an underside of the workpiece for fixing the clamp body on the workpiece, a pressure element for generating clamping pressure to act upon an edge pressure element acting on an edge part, said pressure element being actuatable by means of an actuating element, and a guide provided in said clamp body, the clamping jaws being guideable along said guide for displacement towards one another and away from one another, said clamping jaws comprising clamping jaw members guideable in said guide and clamping surface supports mounted on the clamping jaw members by means of guide bars similar to parallelograms, a securing-in position of the clamp body on the workpiece being achievable by displacing the clamping jaws in the guide in a direction towards the workpiece.

33. An edge clamp as defined in claim 32, wherein the clamping surface supports are movable relative to the clamping jaw members from a position abutting the clamping jaw members into a clamping reinforcing position lifted away from the clamping jaw members.

34. An edge clamp as defined in claim 33, wherein the clamping surface of the clamping surface support is inclined through an angle in the position lifted away from the clamping jaw member in comparison with the position abutting on the clamping jaw member.

35. An edge clamp as defined in claim 34, wherein the inclination of the clamping surface in the position lifted away from the clamping jaw member is selected to compensate at least partially for any widening of the side arms.

36. An edge clamp as defined in claim 33, wherein the clamping surface supports are movable in a pressure direction of the edge pressure element during movement from the position abutting on the clamping jaw member into the position lifted away from the clamping jaw member.

37. An edge clamp comprising:

a clamp body, a first clamping jaw adapted to abut on an upper side of a workpiece and a second clamping jaw adapted to abut on an underside of the workpiece for fixing the clamp body on the workpiece, a pressure element for generating clamping pressure to act upon an edge pressure element acting on an edge part, said pressure element being actuatable by means of an actuating element, and a guide provided in said clamp body, the clamping jaws being guideable along said guide for displacement towards one another and away from one another, wherein:

a securing-in position of the clamp body on the workpiece is achievable by displacing the clamping jaws in the guide in a direction towards the workpiece, and both a clamping of the workpiece between the clamping jaws and an actuation of the pressure element are provided by the actuating element.

38. An edge clamp as defined in claim 37, wherein the actuating element is designed for one-hand actuation.

39. An edge clamp as defined in claim 37, wherein a clamping jaw actuator for actuating the clamping jaws is actuatable with the actuating element.

40. An edge clamp as defined in claim 39, wherein the actuating element is adapted to be coupled to the clamping jaw actuator by means of a releasable coupling.

41. An edge clamp as defined in claim 40, wherein the coupling is designed as a self-releasing coupling when a workpiece is clamped between the clamping jaws.

42. An edge clamp as defined in claim 37, wherein the pressure element is coupled directly to the actuating element.

43. An edge clamp as defined in claim 37, wherein the pressure element comprises a cocking spindle.

44. An edge clamp as defined in claim 41, wherein the coupling is designed as a slip coupling.

45. An edge clamp as defined in claim 24, wherein one of the points of force application acts on the clamp body via an elastic element.

46. An edge clamp as defined in claim 31, wherein the cocking spindle is displaceable in the direction of its spindle axis relative to the actuating element but is non-rotatably connected thereto.

* * * * *

UNITED STATES PATENT AND TRADEMARK OFFICE

CERTIFICATE OF CORRECTION

PATENT NO. : 6,098,972
DATED : Aug. 8, 2000
INVENTOR(S) : Horst Klimach and Hans Roesch It is certified that error appears in the above-identified patent and that said Letters Patent is hereby corrected as shown below:

On the title page: Item

[63] Continuation of application no. PCT/EP98/02236 filed 4/16/98

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*